US006393232B1

(12) United States Patent
Osari et al.

(10) Patent No.: US 6,393,232 B1
(45) Date of Patent: May 21, 2002

(54) IMAGE FORMING APPARATUS CAPABLE OF SELECTING DISCHARGE MEANS ACCORDING TO MATERIAL SELECTION

(75) Inventors: Yoshihito Osari, Shizuoka-ken; Mitsuhiko Sato, Namazu; Nobuo Sekiguchi, Shizuoka-ken; Shunsaku Kondo, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,697

(22) Filed: Jul. 28, 2000

(30) Foreign Application Priority Data

Jul. 30, 1999 (JP) ..... 11-218173

(51) Int. Cl.[7] ..... G03G 15/00
(52) U.S. Cl. ..... 399/82; 399/405
(58) Field of Search ..... 399/16, 45, 81, 399/82, 381, 382, 403, 404, 405, 407, 408, 410, 397; 347/153; 271/279, 288

(56) References Cited

U.S. PATENT DOCUMENTS 4,627,706 A * 12/1986 Takahashi et al. ..... 271/288 X
5,021,837 A 6/1991 Uto et al.
5,136,341 A * 8/1992 Takemura et al. ..... 399/403
5,137,265 A 8/1992 Sato et al. ..... 270/53
5,640,232 A * 6/1997 Miyake et al. ..... 399/82 X
5,710,968 A * 1/1998 Clark et al. ..... 399/382
5,742,890 A * 4/1998 Kato et al. ..... 399/403
5,897,250 A 4/1999 Hirai et al. ..... 399/404
6,091,929 A * 7/2000 Yamazaki et al. ..... 399/410

* cited by examiner

*Primary Examiner*—Sandra Brase
(74) *Attorney, Agent, or Firm*—Fitzpatrick, Cella, Harper & Scinto

(57) ABSTRACT

An image forming apparatus comprising an image forming device for forming an image on a sheet, plural discharged sheet stacking device for stacking the sheet on which the image is formed by the image forming device, and a control device for selecting the discharged sheet stacking device according to the image forming job of the image forming device and for selecting the discharged sheet stacking device based on the material information of the sheet, wherein the control device selects the discharged sheet stacking device based on the material of the sheet in preference to the image forming job. The image forming job is a stapling job, a sorting job or a non-stapling and non-sorting job. There is also provided an informing device for informing a fact that the discharged sheet stacking device is selected based on the material of the sheet in preference to the image forming job.

22 Claims, 16 Drawing Sheets

IMAGE FORMING APPARATUS CAPABLE OF SELECTING DISCHARGE MEANS ACCORDING TO MATERIAL SELECTION

BACKGROUND OF THE INVENTION

1. Field of the Invention

The present invention relates to an image forming apparatus such as a copying apparatus for executing a copy job, a printer for executing a print job, a facsimile apparatus or a compound apparatus thereof, having at least two sheet discharge locations and capable of designating such discharge location.

2. Related Background Art

In the image forming apparatus, it is made possible, by employing an image memory device such as a hard disk serving as an image server, to execute the image processing operation for plural images by a single image input operation, instead of the plural image input operations corresponding to the number of images as required in the prior image forming apparatus. Such function allows to promptly release the image input process, thereby shortening the user binding time required for example for recovering the bundle of the original documents or for transferring the originals on the network, and to execute the printing jobs of a larger number in more efficient manner, in combination with the above-mentioned image process scheduling function.

Also the image forming apparatus with the image memory device is increasingly equipped, utilizing the feature capable of producing plural copies by a single image input process, with a sheet discharge device of finisher type, for producing the output of plural copies, capable of producing the output sheet bundle at a time rather than a sheet discharge device of sorter type which generates the plural copies at the same time whereby the completion of the final output sheet bundle takes a longer time.

Among such sheet discharge devices of finisher type, there is known a device provided with plural discharged sheet stacking portions, constituting the discharged sheet stacking means, and capable of utilizing such stacking portions according to the type or purpose of the job and selecting the discharged sheet stacking portions for each job type or for each job, in order enable easy access when the plural users fetch the output sheet bundles after the sheet output operation.

Among such sheet discharge devices of finisher type having the plural discharged sheet stacking portions, however, some devices can only discharge the sheet of a transparent material (hereinafter called "material") such as an overhead projection sheet (hereinafter called OHP sheet) onto a predetermined discharged sheet stacking portion, because of the difference in the path configuration to each discharged sheet stacking portion or the difference in the sensor configuration.

Also a sheet of special size such as of free size is often dischargeable only to a certain discharged sheet stacking portion.

Further, in execution of a tab mixed mode or the like for producing an output bundle containing tab sheets, the tab sheets are used in a set of predetermined number in each bundle (for example 5 sheets as a set in case of 6-tab sheets). In such tab mixed mode, for example if there are set three tab sheet inserting positions and if it is desired to discharge the remaining two tab sheets to another sheet stacking portion, such discharge may not be possible because of the positional configuration in relation to post-processing units such as the stapler.

SUMMARY OF THE INVENTION

In consideration of the foregoing, the object of the present invention is to provide an image forming apparatus capable, in case the sheet discharge is not possible to the discharged sheet stacking means designated for each job according to the material, sheet size or operation mode, of invalidating such discharged sheet stacking means and discharging the sheets without interrupting the process, thereby executing the job without reducing the throughput of the entire system.

The above-mentioned object can be attained, according to the present invention, by an image forming apparatus comprising image forming means for forming an image on a sheet, plural discharged sheet stacking means for stacking the sheet on which the image is formed by the image forming means, and control means capable of selecting the discharged sheet stacking means according to an image forming job of the image forming means and also capable of selecting the discharged sheet stacking means based on the material information of the sheet, wherein the control means is adapted to select the discharged sheet stacking means based on the material of the sheet in preference to the image forming job.

The image forming job may be a stapling job, a storing job or a non-stapling and non-sorting job.

According to the present invention, the image forming apparatus further comprises informing means for informing a fact that the discharged sheet stacking means is selected based on the material of the sheet in preference to the image forming job.

According to the present invention, there is also provided an image forming apparatus comprising plural image data input means for entering image data, image forming means for forming an image on a sheet based on the image data, plural discharged sheet stacking means for stacking the sheet on which the image is formed by the image forming means, and control means capable of selecting the discharged sheet stacking means corresponding to each image data input means and also capable of selecting the discharged sheet stacking means based on the material information of the sheet, wherein the control means is adapted to select the discharged sheet stacking means based on the material of the sheet in preference to the kind of the image data input means.

According to the present invention, the image forming apparatus further comprises informing means for informing a fact that the discharged sheet stacking means is selected based on the material of the sheet in preference to the image data input means.

According to the present invention, the image data input means can be a telephone line, an external computer or a reader portion.

Also in the image forming apparatus of the present invention, the sheet can be a sheet for an overhead projector.

Also according to the present invention, there is provided an image forming apparatus comprising image forming means for forming an image on a sheet, plural discharged sheet stacking means for stacking the sheet on which the image is formed by the image forming means, and control means capable of selecting the discharged sheet stacking means according to an image forming job of the image forming means and also capable of selecting the discharged sheet stacking means based on the size information of the sheet, wherein the control means is adapted to select the discharged sheet stacking means based on the size information of the sheet in preference to the image forming job.

According to the present invention, the image forming apparatus further comprises informing means for informing a fact that the discharged sheet stacking means is selected based on the size information of the sheet in preference to the image forming job.

The size information of the sheet may include information that the sheet is free size.

According to the present invention, there is also provided an image forming apparatus comprising plural image data input means for entering image data, image forming means for forming an image on a sheet based on the image data, plural discharged sheet stacking means for stacking the sheet on which the image is formed by the image forming means, and control means capable of selecting the discharged sheet stacking means corresponding to each image data input means and also capable of selecting the discharged sheet stacking means based on the size information of the sheet, wherein the control means is adapted to select the discharged sheet stacking means based on the size information of the sheet in preference to the kind of the image data input means.

According to the present invention, the image data input means can be a telephone line, an external computer or a reader portion.

According to the present invention, the image forming apparatus further comprises informing means for informing a fact that the discharged sheet stacking means is selected based on the size information of the sheet in preference to the image data input means.

Also in the image forming apparatus of the present invention, the sheet can be a sheet for a free size.

Also according to the present invention, there is provided an image forming apparatus comprising image forming means for forming an image on a sheet, plural discharged sheet stacking means for stacking the sheet on which the image is formed by the image forming means, image forming mode setting means for setting an image forming mode relating to the image forming means, and control means capable of selecting the discharged sheet stacking means according to an image forming job of the image forming means and also capable of selecting the discharged sheet stacking means based on the image forming mode set by the image forming mode setting means, wherein the control means is adapted to select the discharged sheet stacking means based on the image forming mode in preference to the image forming job.

According to the present invention, the image forming apparatus further comprises informing means for informing a fact that the discharged sheet stacking means is selected based on the image forming mode in preference to the image forming job.

According to the present invention, there is also provided an image forming apparatus comprising plural image data input means for entering image data, image forming means for forming an image on a sheet based on the image data, plural discharged sheet stacking means for stacking the sheet on which the image is formed by the image forming means, image forming mode setting means for setting an image forming mode, and control means capable of selecting the discharged sheet stacking means corresponding to each image data input means and also capable of selecting the discharged sheet stacking means based on the image forming mode, wherein the control means is adapted to select the discharged sheet stacking means based on the image forming mode in preference to the kind of the image data input means.

According to the present invention, the image forming apparatus further comprises informing means for informing a fact that the discharged sheet stacking means is selected based on the image forming mode in preference to the kind of the image data input means.

In the image forming apparatus of the present invention, an image forming mode set by the image forming mode setting means is a tab sheet insertion mode for generating a series of a sheet bundle containing tab sheets.

In the image forming apparatus of the present invention, the plural discharged sheet stacking means include a first tray for stacking sheet bundles stapled by stapling means and a second tray for stacking unstapled sheets, wherein the first and second trays are mutually positioned above and below, and the second tray can be placed in a position for receiving the unstapled sheets when the first tray is in a position for receiving the stapled sheets, and the image forming mode includes a tab mode for inserting tab sheets, in which the first and second trays are preferentially positioned as described above in the tab mode and the surplus tab sheet is discharged to the second tray.

In the image forming apparatus of the present invention, the plural discharged sheet stacking means include a first tray for stacking sheet bundles stapled by stapling means and a second tray for stacking unstapled sheets, wherein the first and second trays are mutually positioned above and below so as to correspond to respective discharge exits, and the first tray is adapted to receive the stapled sheets corresponding to a first discharge exit while the second tray is adapted to received unstapled sheets corresponding to a second discharge exit or stapled sheets corresponding to the first discharge exit.

In the image forming apparatus of the present invention, the second tray is adapted, when the first tray is full, to move to the first discharge exit and to receive the stapled sheets.

In the image forming apparatus of the present invention, the first discharge exit is positioned below while the second discharge exit is positioned thereabove, and a conveying path leading to the first discharge exit is provided therein with a stapling tray and stapling means and is curved, while a conveying path leading to the second discharge exit is substantially straight.

The image forming apparatus of the present invention, being adapted to select the discharge sheet stacking means based on the material of the sheet in preference to the image forming job, is capable of invalidating the designation of the sheet stacking means in case the sheet cannot be discharged to the sheet stacking means corresponding to the job according to the material mode, thereby achieving sheet discharge without interruption and executing the job without sacrificing the throughput of the entire system.

The image forming apparatus of the present invention, being provided with the informing means, is capable of informing the user of a fact that the discharged sheet stacking means is not as designated, thereby preventing confusion in the work.

The image forming apparatus of the present invention, being adapted to select the discharged sheet stacking means based on the material of the sheet in preference to the image data input means, is capable of invalidating the designation of the sheet stacking means in case the sheet cannot be discharged to the sheet stacking means corresponding to the job according to the material mode, thereby achieving sheet discharge without interruption and executing the job without sacrificing the throughput of the entire system.

The image forming apparatus of the present invention, being adapted to select the discharge sheet stacking means based on the sheet size in preference to the image forming job, is capable of invalidating the designation of the sheet stacking means in case the sheet cannot be discharged to the sheet stacking means corresponding to the job according to the size mode, thereby achieving sheet discharge without interruption and executing the job without sacrificing the throughput of the entire system.

The image forming apparatus of the present invention, being adapted to select the discharged sheet stacking means based on the sheet size in preference to the image data input means, is capable of invalidating the designation of the sheet stacking means in case the sheet cannot be discharged to the sheet stacking means corresponding to the job according to the size mode, thereby achieving sheet discharge without interruption and executing the job without sacrificing the throughput of the entire system.

The image forming apparatus of the present invention, being adapted to select the discharged sheet stacking means based on the image forming mode in preference to the image forming job, is capable of invalidating the designation of the sheet stacking means in case the sheet cannot be discharged to the sheet stacking means corresponding to the job according to the material mode, thereby achieving sheet discharge without interruption and executing the job without sacrificing the throughput of the entire system.

The image forming apparatus of the present invention, being adapted to select the discharge sheet stacking means based on the image forming mode in preference to the image data input means, is capable of invalidating the designation of the sheet stacking means in case the sheet cannot be discharged to the sheet stacking means corresponding to the job according to the material mode, thereby achieving sheet discharge without interruption and executing the job without sacrificing the throughput of the entire system.

BRIEF DESCRIPTION OF THE DRAWINGS

FIGS. 7A and 7B are views showing examples of display screens on a display panel by user setting keypads, wherein FIG. 7A shows an example of the display screen for designating the discharged sheet stacking means while FIG. 7B shows an example of the display screen for setting a dedicated tray;

FIGS. 8A, 8B and 8C are views showing examples of display screens for material designation and size designation for the manual feeding tray, wherein FIG. 8A shows the display panel after the selection of a sheet selection keypad, FIG. 8B shows the display panel for setting the sheet size for the manual feeding tray, and FIG. 8C shows the display panel after closing the sheet setting screen for the manual feeding tray;

FIGS. 9A, 9B and 9C are views showing examples of a screen for setting an application mode for the image forming apparatus and a tab sheet inserting mode setting screen, wherein FIG. 9A shows the display panel indicating setting keypads for various application function modes, FIG. 9B shows the display panel for setting a tab number, and FIG. 9C shows the display panel for setting the tab sheet inserting position;

DETAILED DESCRIPTION OF THE PREFERRED EMBODIMENTS

Now the present invention will be clarified in detail by preferred embodiments thereof, with reference to the accompanying drawings.

Figure 1:
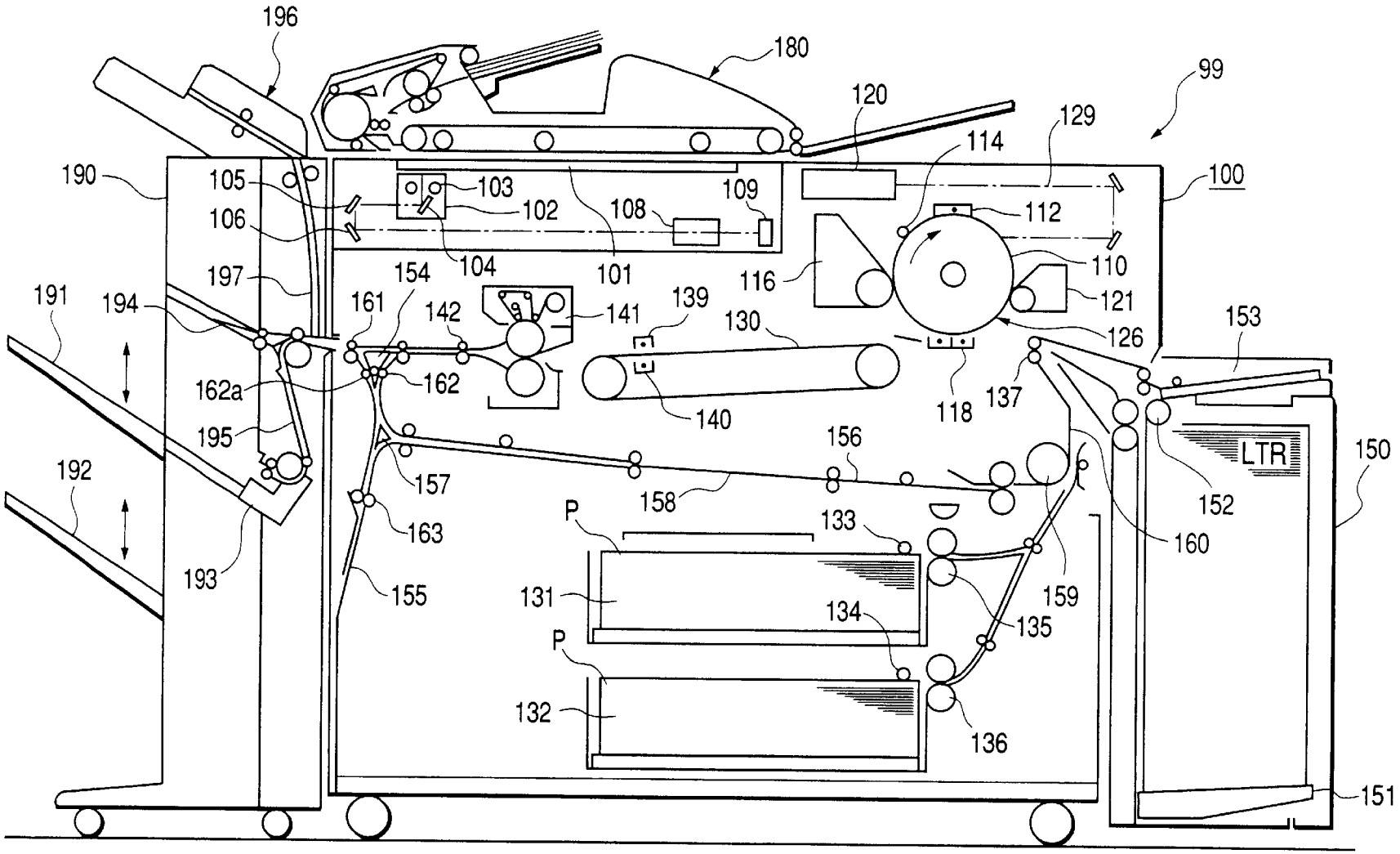
FIG. 1 is a schematic frontal cross-sectional view of an image forming apparatus of an embodiment of the present invention.

In FIG. 1, on a main body 100 of an image forming apparatus 99, there is provided an automatic original feeder (hereinafter represented as DF) 180.

Referring to FIG. 1, a platen glass plate 101 constitutes an original supporting plate. A scanner 102 is composed of an original illuminating lamp 103, a scanning mirror 104 etc. The scanner is put into a reciprocating scanning motion in a predetermined direction by an unrepresented motor, and the light reflected from the original is guided through scanning mirrors 104 to 106 and a lens 108 and is imaged on a CCD sensor 109. An exposure control portion 120 is composed of a laser, a polygon scanner etc. and irradiates a photosensitive drum 110 with a laser beam 129 modulated according to an image signal, obtained by conversion into an electrical signal in the image sensor portion and by predetermined image processing to be explained later. Around the photosensitive drum 110 there are provided a primary charger 112, a developing device 121, a transfer charger 118, a cleaning device 116 and a pre-exposure lamp 114 constituting an image forming portion.

In the image forming portion 126, the photosensitive drum 110 is rotated by an unrepresented motor in a direction indicated by an arrow, then charged to a desired potential by the primary charger 112 and irradiated by the laser beam 129 from the exposure control portion 120 whereby an electrostatic latent image is formed. The electrostatic latent image formed on the photosensitive drum 110 is developed by the developing device 121 as a visible toner image.

On the other hand, a sheet P fed from an upper cassette 131 or a lower cassette 132 by pick-up rollers 133, 134 is conveyed to the main body by sheet supplying rollers 135, 136, then is conveyed to a transfer belt by registration rollers 137 and the visible toner image is transferred to the sheet by a transfer charger 118.

The above-mentioned sheet can be ordinary paper, a thin resinous sheet used as a substitute for ordinary paper, cardboard, an envelope or a thin plastic plate.

After the image transfer, the photosensitive drum is subjected to cleaning of the remaining toner by a cleaner device 116 and elimination of residual charge by the pre-exposure lamp 114. The sheet after the image transfer is subjected to the re-charging of the toner image by ante-fixation chargers 139, 140, then is forwarded to a fixing device 141 in which the toner image is fixed by heat and pressure, and is discharged from the main body 100 by discharge rollers 142.

At the right-hand side of the main body 100, there is provided a deck 150 capable of housing for example 4,000 sheets. A lifter 151 of the deck 150 is so constructed as to elevate according to the amount of the sheets, in such a manner that the sheets are always in contact with a pickup roller 152. Also there is provided a multi-manual feeding tray 153 capable of containing 100 sheets.

Further referring to FIG. 1, a discharge flapper 154 provided in the left-hand side in the main body 100 serves to switch the sheet discharge path to a two-sided recording side or a multi-recording side. The sheet advanced from the discharge rollers 142 is switched, by the discharge flapper 154 either to the two-sided recording side or to the multi-recording side.

A lower conveying path 158 reverses the surface of the sheet, advanced from the discharge rollers 142, through a surface reversing path 155 and guides the sheet to a re-feeding tray 156. A multi-flapper 157 for switching the two-sided recording path and the multi-recording path, can directly guide the sheet to the lower conveying path 158 without going through the surface reversing path 155 when the multi-flapper 157 is positioned at the left side.

A sheet supplying roller 159 serves to supply the sheet to the photosensitive drum 110 through a path 160. Discharge rollers 161 are positioned in the vicinity of the discharge flapper 154 and serve to discharge the sheet, switched to the discharge side by the discharge flapper 154, from the main body of the apparatus.

In the two-sided copying or in the multi-copying, the discharge flapper 154 is lifted up to store the sheet after copying to the re-feeding tray 156 through the conveying paths 155, 158. In such operation, in case of the two-sided copying or the multi-recording, the multi-flapper 157 is respectively shifted to the right or to the left. The sheets contained in the re-feeding tray 156 are fed one by one from the lowermost sheet, by the supplying roller 159 to the registration rollers 137 of the main body through the path 160.

In case of discharging sheet with surface reversal from the main body, the discharge flapper 154 is lifted up while the flapper 157 is shifted to the right whereby the sheet after copying is conveyed toward the path 155. After the trailing end of the sheet passes through a first feeding roller 162, the sheet is conveyed by a reversing roller 163 toward a second feeding roller, and is discharged from the main body with surface reversal by the discharge rollers 161.

A discharge process unit 190 is provided for aligning and stapling the sheets discharged from the image forming apparatus 100. In case a post-processing operation for the discharged sheet bundle such as sorting or stapling is not set in an operating portion 172 to be explained later, the sheets are discharged one by one to a discharge tray 191 through a path 194, without passing a processing tray 193. In case a post-processing operation for the discharged sheet bundle is set, the sheets discharged one by one through a conveying path 195 are stacked and jogged on the processing tray 193. After the discharge of the image bearing sheets corresponding to a copy, the bundle of the sheets is stapled and discharged to a discharge tray 192 or 191. When such post-processing operation for the discharged sheet bundle is selected, the bundle is basically discharged to the discharge tray 192, but, it is switched to the discharge tray 192 according to the stacking state etc. The discharge trays 191, 192 are moved vertically by an unrepresented motor to a position constituting the processing tray before the start of the image forming operation.

A non-imaging sheet inserting device 196 is provided above the discharge process unit 190.

In case a non-imaging sheet inserting operation such as a cover sheet mode is set in the operating portion 172 to be explained later, a non-imaging sheet stored in advance in the non-imaging sheet inserting device 196 is conveyed through a conveying path 197 to the conveying path 194 or 195 and is discharged to the discharge exit same as that for the sheets discharged from the image forming apparatus 99.

Figure 2:
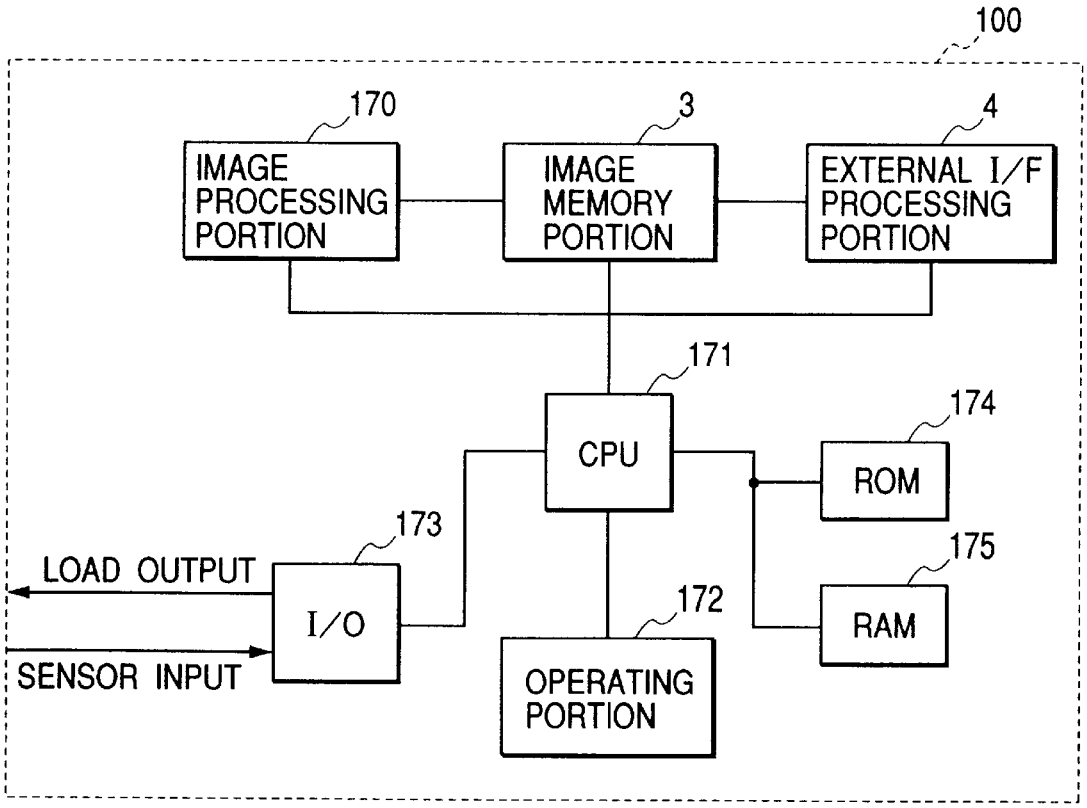
FIG. 2 is a control block diagram of the image forming apparatus shown in FIG. 1.

FIG. 2 is a control block diagram of the image forming apparatus 99. A CPU 171 executes basic control of the image forming apparatus 99 and is connected with a ROM 174 storing the control program, a work RAM 175 for data processing and an I/O port 173 through address and data busses.

The I/O port 173 is connected to various loads (not shown) such as motors and clutches for controlling the image forming apparatus 99, and input devices (not shown) such as sensors for detecting the sheet position.

The CPU 171 executes the image forming operation by controlling the input and output devices in succession through the I/O port 173 according to the content of the ROM 174. The CPU 171 is also connected to an operating portion 172 for controlling display means and keypad input means thereof.

When the user instructs an image forming mode or a switching of the display to the CPU 171 through the keypad input means, the CPU 171 displays the state of the image forming apparatus 99 or the operation mode set by the keypad input. The CPU 171 is further connected to an image processing portion 170 for processing the electrical signal converted in an image sensor portion 109 and an image memory portion 3 for storing the processed image.

Figure 3:
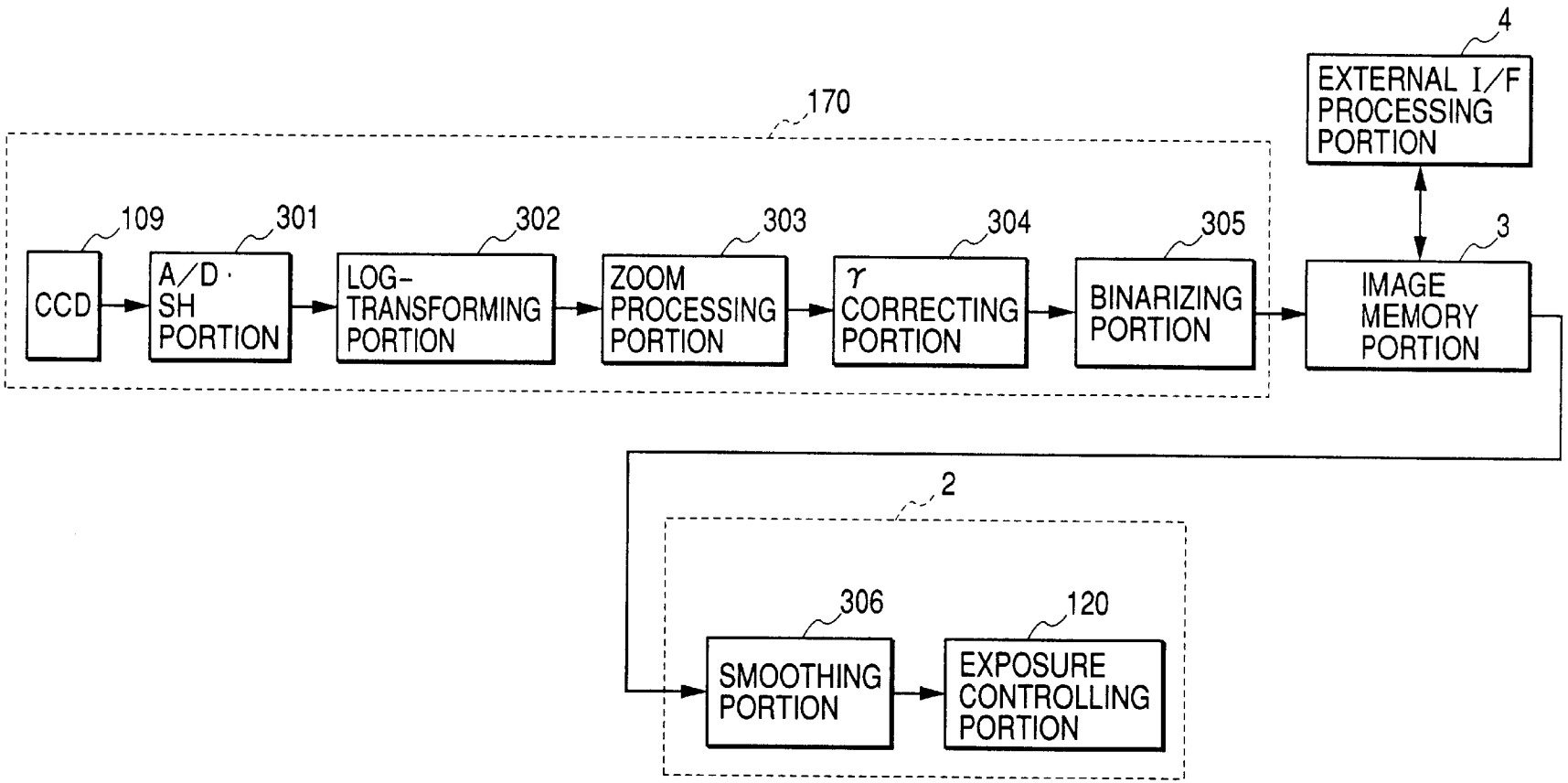
FIG. 3 is a control block diagram of an image processing portion in the block diagram shown in FIG., 2.

In the following there will be given an explanation on the image processing portion 170 with reference to FIG. 3 which is a block diagram thereof.

An original image, imaged on a CCD sensor 109 through a lens 108 (cf. FIG. 1), is entered as black luminance data, and is converted into an analog electrical signal by the CCD sensor 109.

The converted image information is entered into an analog signal processing portion (not shown) for sample holding, dark level correction etc., then is subjected to analog-digital (A/D) conversion in an A/D converting portion 301, and thus digitized signal is subjected to shading correction (correction for the fluctuation in the original reading sensors and for the light distribution characteristics of the original illuminating lamp). The signal is then supplied to a logarithmic transforming portion 302.

The logarithmic transforming portion 302 is provided with a look-up table (LUT) for transforming the input luminance data into density data, and transforms the luminance data into density data by outputting a table value corresponding to the input data. The image data are thereafter converted into a desired image magnification by a zoom processing portion 303 and are entered into a $\gamma$ correcting portion 304.

The γ correcting portion 304 executes LUT conversion in consideration of the printer characteristics at the output of the density data, thereby regulating the output according to a density value set by the operating portion 172. The image data are then supplied to a binarizing portion 305.

The binarizing portion 305 executes binarization of the multi-value density data into a density value "0" or "255". Thus the 8-bit image data are binarized into 1-bit image data of "0" or "1", whereby the amount of the image data to be stored in the memory can be reduced.

However, since the binarization of the image reduces the number of gradation levels of the image from 256 to 2, the image data rich in halftone gradation levels such as a photographic image generally shows significant deterioration of the image quality upon binarization. It is therefore necessary to execute pseudo halftone representation by the binary data.

For such pseudo halftone representation with the binary data, there is adopted the error diffusion method, in which, after binarization of the density of a certain pixel to a density "255" or "0" respectively if the density is larger than smaller than a threshold value, the difference between the actual density data and the binarized data is distributed as an error signal to the surrounding pixels.

The error distribution is executed by multiplying the error resulting from binarization with weighting coefficients prepared in advance for the matrix and adding the results of such multiplication to the surrounding pixels. Thus the average density is conversed for the entire image, and the halftone image can be represented in pseudo manner by the binary values.

The binarized image data are supplied to and stored in the image memory portion 3. Also image data from a computer, entered through an external I/F processing portion 4, are processed therein as binary image data and are therefore directly supplied to the image memory portion 3. The image memory portion 3 is provided with a high-speed page memory portion 401 and a large-capacity memory (hard disk) 404 capable of storing the image data of plural pages.

The plural image data stored in the hard disk are outputted in an order corresponding to an editing mode designated by the operating portion of the image forming apparatus 99. For example, in case of a sorting mode, the images of the bundle of the originals read by the DF 180 are outputted in the sequential order. The image data of the originals stored in the hard disk are read therefrom and such reading operation is repeated plural times, whereby attained is a function equivalent to that of a sorter with plural bins.

The image data from the image memory portion 3 are supplied to a smoothing portion 306 in the printer portion 2. The smoothing portion 306 executes data interpolation in such manner that the edge portion of the binarized image becomes smooth, and sends the image data to the exposure controlling portion 120, which forms an image corresponding to the image data on the sheet according to the above-described process.

Figure 4:
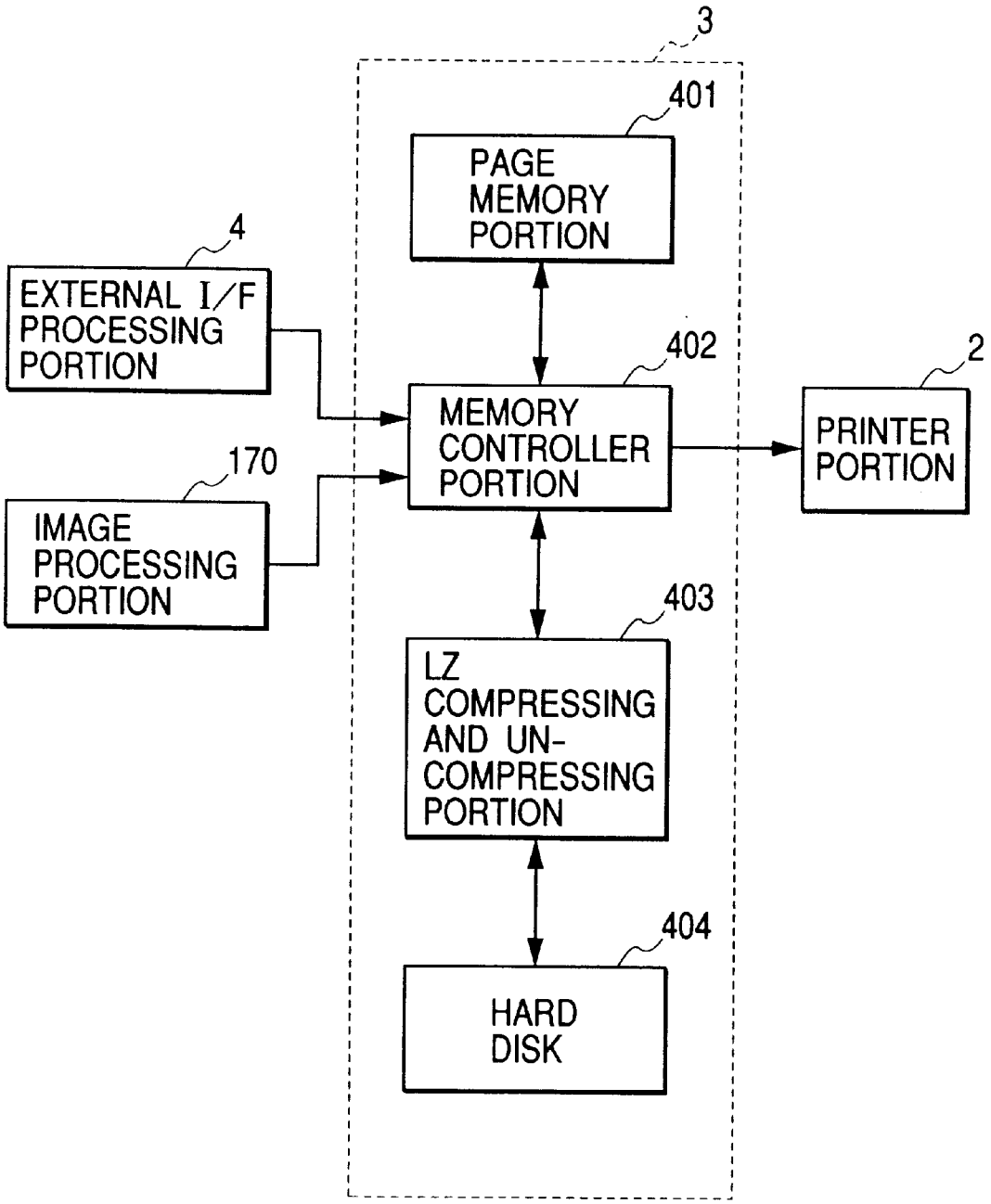
FIG. 4 is a control block diagram of an image memory portion in the block diagram shown in FIG. 2.

In the following there will be explained the configuration of the image memory portion 3 with reference to FIG. 4.

The image memory portion 3 executes writing of a binary image from the external I/F processing portion 4 or an image processing portion 170 through a memory controller portion 402 into a page memory portion 401 constituted by a memory such as a DRAM, image readout to the printer portion 2, and access to the hard disk 404 constituting the large-capacity memory portion, for image input/output.

The memory controller portion 402 generates a DRAM refresh signal for the page memory portion 401, and arbitrates access to the page memory portion 401 from the external I/F processing portion 4, the image processing portion 170 and the hard disk 404. The memory controller portion 402 control the writing address to the page memory portion 401, and the reading address and reading direction from the page memory portion 401 according to the instruction from the CPU 171. Thus the CPU 171 controls, for example, a function of forming a layout of plural original images in the page memory portion 401 and outputting such images to the printer portion, a function of cutting out and outputting only a part of the image and an image rotating function.

In the following there will be explained the configuration of the external I/F processing portion 4 with reference to FIG. 5.

As explained in the foregoing, the external I/F processing portion 4 fetches the binary image data from the reader portion through the image memory portion 3, and outputs the binary image data through the image memory portion 3 to the printer portion 2 for image formation. The external I/F processing portion 4 is provided with a core portion 506, a facsimile portion 501, a hard disk 502 for storing the communication image data of the facsimile portion, a computer interface portion 503 connected with an external computer 11, a formatter portion 504, an image memory portion 505 etc.

The facsimile portion 501 is connected with a public circuit (or phone line) through a modem (not shown), and executes reception of the facsimile communication data from the public circuit and transmission of the facsimile communication data to the public circuit. The facsimile portion 501 executes facsimile functions such as facsimile transmission at a designated time and image data transmission in response to an inquiry by a designated password from a partner, by storing the facsimile image in the hard disk 502.

Thus, once the image is transferred from the reader portion 1 through the image memory portion 3 to the facsimile hard disk 502 of the facsimile portion 501, the facsimile transmission can be executed without utilizing the reader portion 1 or the image memory portion 3.

The computer interface portion 503 is so constructed as to execute data communication with external computers and is provided for example with a serial I/F for a local area network (LAN), a SCSI I/F, a centronics I/F for data input to the printer.

The external I/F processing portion 4 informs the state of the printer portion and the reader portion to the external computer through such I/F, also transfers the image read by the reader portion 1 to the external computer under the instruction by the computer, and receives the print image data from the external computer. The print data transferred from the external computer through the computer interface portion 503, being described in exclusive printer code, are converted in the formatter portion 504 into raster image data for image formation by the printer portion 2 through the image memory portion 3.

The formatter portion 504 develops the raster image data in the image memory portion 505. The image memory portion 505 is used for developing the raster image data by the formatter portion 504, and, also in case of transferring the image data from the reader portion 1 to the external computer through the computer interface portion 503 (image scanner function), for developing the image data from the image memory portion 3, for conversion into a data format to be transmitted to the external computer and for data transmission from the computer interface portion 503.

The core portion 506 controls the data transfer among the facsimile portion 501, computer interface portion 503, formatter portion 504, image memory portion 505 and image memory portion 3. Thus the image output can be attained with exclusive control and priority control under the management by the core portion 506, even in case the external I/F processing portion 4 has plural image output portions or in case only one image transfer path is provided to the image memory portion 3.

In the following there will be explained, with reference to FIG. 6, the operating portion for setting the copying operation of the image forming apparatus shown in FIG. 1.

Figure 6:
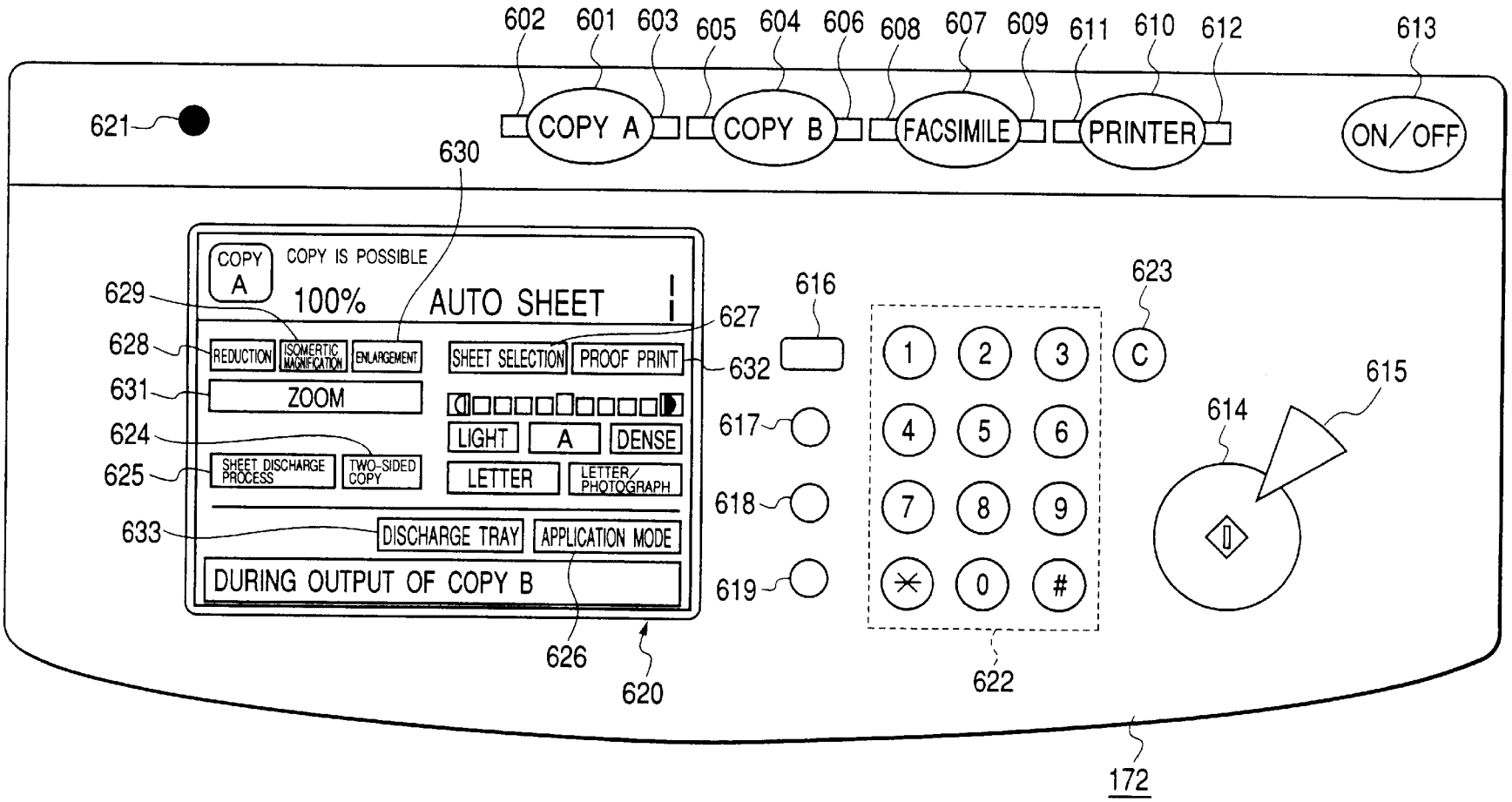
FIG. 6 is a plan view of an operation portion of the image forming apparatus shown in FIG. 1.

Referring to FIG. 6, a power lamp 621, indicating the state of the power supply, is turned on or off by turning on/off of the power supply by a power switch 613. Numeric keypads 622 are used for setting the number of image formations or entering a number for mode setting. They are also used for entering a telephone number in a facsimile setting image.

A clear keypad 623 is used for clearing the setting entered by the numeric keypads 622. A reset keypad 616 is used for returning the set number of the image formations, the operation mode, or the selected mode for the sheet feeding means to an initial state. A start keypad 614 is used for starting the image forming operation, upon being depressed by the user. At the center of the start keypad 614, there are provided red and green LED's (not shown) for indicating whether the start is possible, and the green or red LED is turned on respectively if the start is possible or not. A stop keypad 615 is used for interrupting the copying operation.

A guide keypad 617 is, when depressed followed by depression of another keypad, to cause a display panel 620 to execute a guide display of the explanation of the function that can be set by such another keypad. Such guide display can be cancelled by repeated depression of the guide keypad 617.

A user setting keypad 618 is, when depressed, to change the setting of the image forming apparatus. The setting that can be changed by the user covers all the functions common to the printing and copying, such as the time to the automatic clearing of setting, the settings relating to the timer, the setting of dedicated tray etc.

Figure 7A:
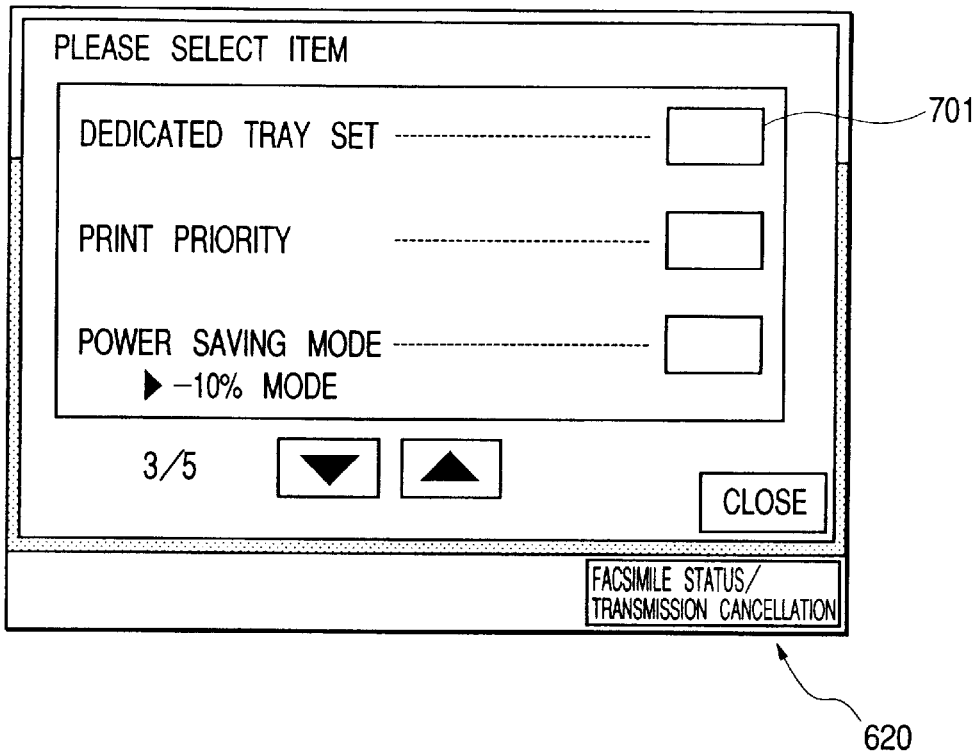

FIG. 7A shows a screen for setting all the functions common to the printing and copying. The illustrated example shows a screen for setting a dedicated tray.

Figure 7B:
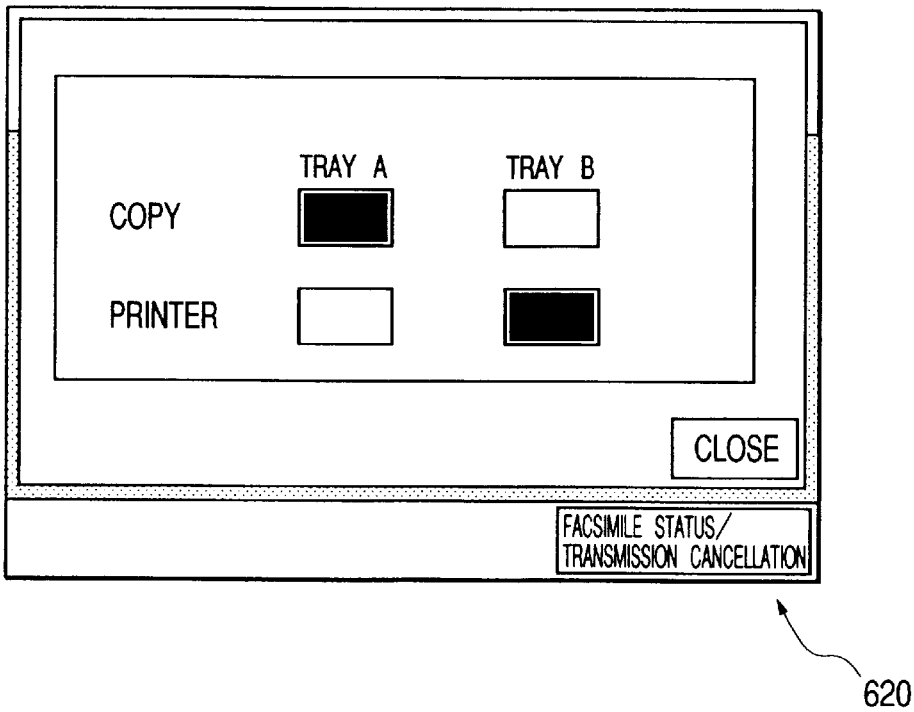

FIG. 7B shows a screen for setting the dedicated tray, displayed after the depression of a dedicated tray setting keypad 701 shown in FIG. 7A. In this screen, the copy job or printer job can be assigned to the output tray A or B or both of them.

When both trays are selected, the output tray is switched according to the output mode (sorting, non-sorting etc.) in the job of such type. In the illustrated example, the copy job is assigned to the tray A while the printer job is assigned to the tray B.

Again referring to FIG. 6, an interruption keypad 619 is, if depressed in the course of an image forming operation, to interrupt other image forming operations, thereby enabling the copying operation without the automatic original feeder 180 (cf. FIG. 1).

The display panel 620, composed for example of a liquid crystal display panel, changes the content of display according to the mode setting, for facilitating detailed setting of the mode. The surface of the display panel constitutes a touch panel.

FIG. 6 shows a screen for setting the copying operation mode. In FIG. 6, keypads 624 to 632 are displayed in the display panel 620 and the mode setting is executed by judging the depression of a keypad when the display position thereof is touched by the user.

A sheet cassette selecting keypad 627 (cf. FIG. 6) is, when depressed, to cause the display panel 620 to display a screen for selecting the sheet feeding from the cassette 131 or 132, deck 150 or manual feeding tray 153.

The cassette setting image will be explained with reference to FIGS. 8A, 8B and 8C, which show the display panel 620 after the depression of a sheet selecting keypad 627.

Figure 8A:
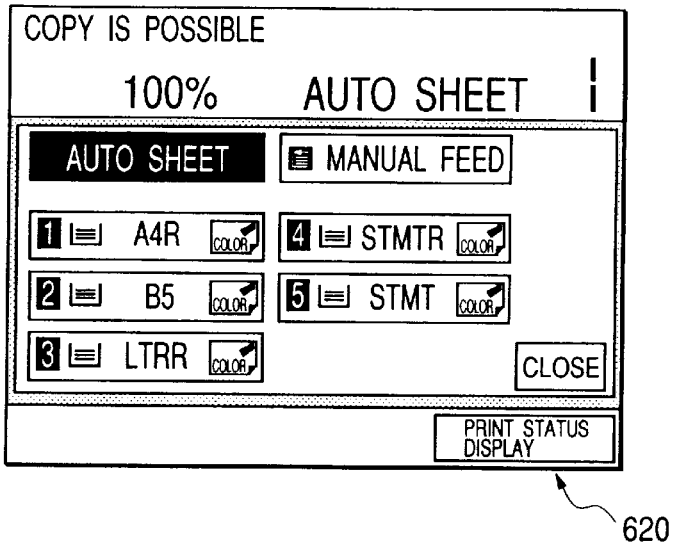

FIG. 8A shows the display panel 620 which, in the absence of sheet on the manual feeding tray 153, indicates that the sheet size of the manual feeding tray 153 is not fixed.

Figure 8B:
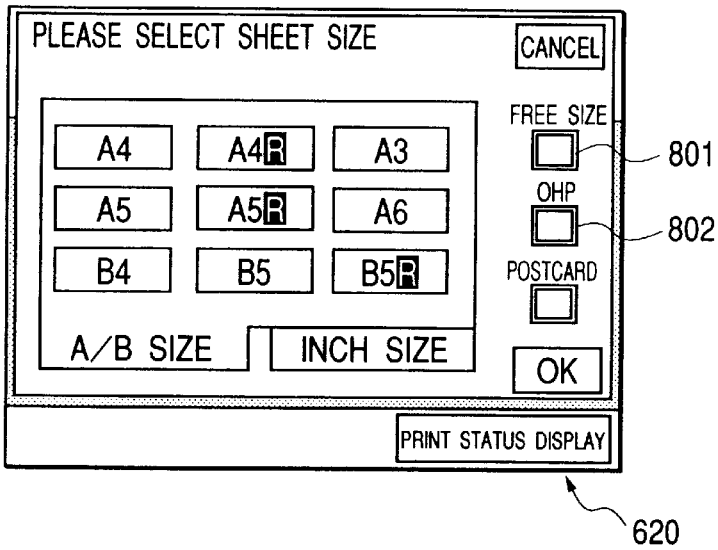

FIG. 8B shows the display panel 620 in a state for setting the sheet size of the manual feeding tray 153.

This screen is displayed when a sheet is set on the manual feeding tray 153.

In this displayed screen, the size is set by depressing a keypad of the size corresponding to the size of the sheet set on the manual feeding tray 153.

If the size of the sheet on the manual feeding tray is free size, a free size keypad 801 is depressed to designate the free size in this screen.

This screen can also be used for designating the material of the sheet on the manual feeding tray. In case the sheet is an OHP sheet, an OHP setting keypad 802 is depressed to achieve setting therefor.

Figure 8C:
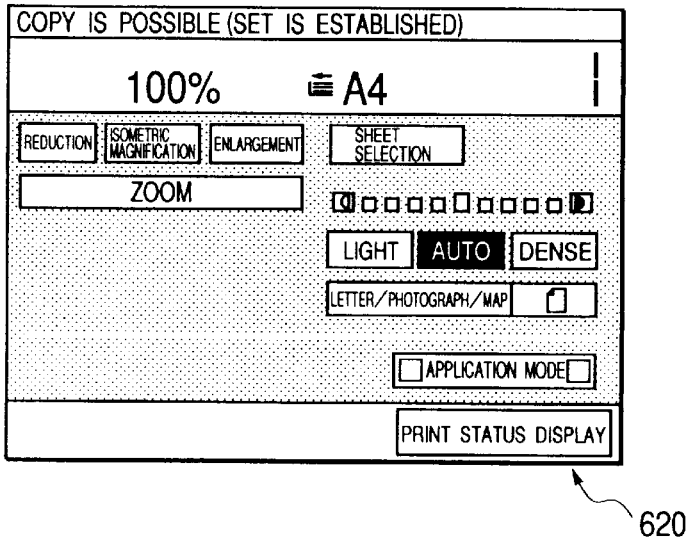

FIG. 8C shows the display panel 620 in a state after setting an A4 size in the display shown in FIG. 8B and closing the sheet setting screen for the manual feeding tray shown in FIG. 8B.

Figure 9A:
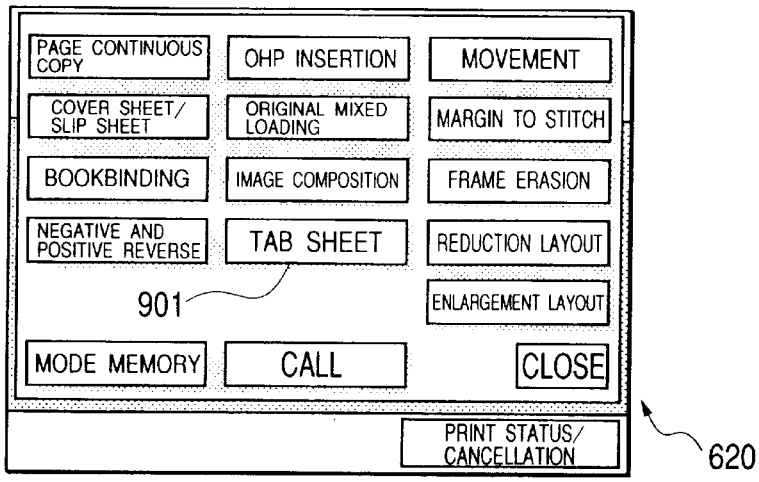
Figure 9B:
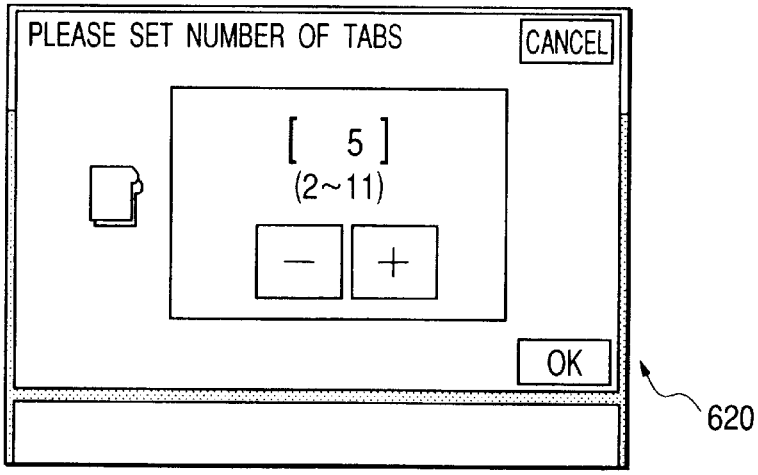

Again referring to FIG. 6, keypads 628, 631 are provided for setting the copying magnification of the copying operation. An application mode setting keypad 626, upon depression, causes the display panel to display an image for setting application function modes such as a multi-copying mode, a reduction layout mode, a cover sheet mode, a slip sheet mode etc. with setting keypads for such modes as shown in FIG. 9A, thereby enabling setting of such application modes. FIG. 9B shows a screen for setting a tab sheet insertion mode, to be displayed upon depression of a tab sheet mode keypad 901 in the image shown in FIG. 9A, and is used for setting the kind of the tab sheets (number of tabs) to be used in the execution of the tab sheet mode.

Figure 9C:
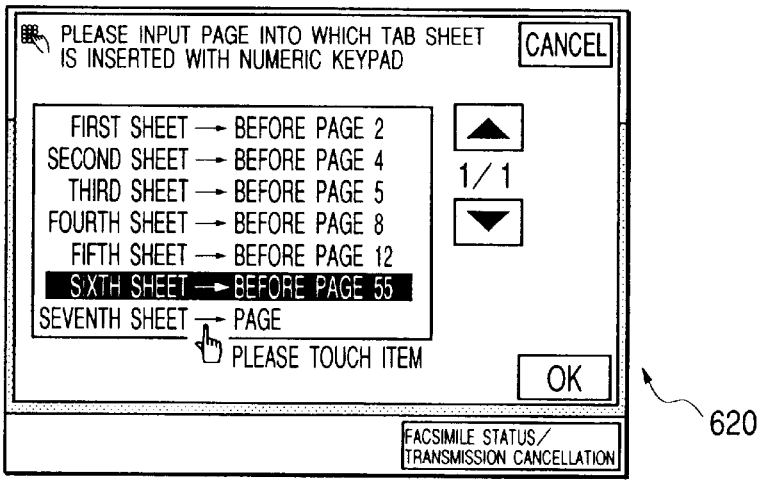

FIG. 9C shows a screen for setting the tab sheet inserting positions. In case the number of the inserting positions set in this image is not a multiple of the number of tabs set in the image shown in FIG. 9B, surplus tab sheet or sheets are generated in the sets of the tab sheets. In such case, such surplus tab sheet is discharged, at the discharge of sheets of a copy, to a location other than the discharging or stacking location for such print job.

Again referring to FIG. 6, a two-sided operation setting keypad 624 is used for setting a "single to two-sided mode" for two-sided output from single-sided originals, or a "two to two-sided mode" for two-sided output from a two-sided original, or a "two to single-sided mode" for two single-sided outputs from a two-sided original. A discharge process setting keypad 625 is, upon depression, to set the operation mode of the discharge process unit 190 (cf. FIG. 1) or to set the sorting mode of the output sheets utilizing the image memory.

Each keypad in the display panel is displayed in the ordinary state or by broken lines (half-tone dot meshing) to indicate that such keypad is in a disabled state.

In the example shown in FIG. 6, the upper part of the display panel 620 displays the set content of the copying operation and the current operation state thereof. The upper left part of the image indicates the function modes, to be explained later, to which the current image belongs. The example shown in FIG. 6 displays a setting image for the copy job A. In the example shown in FIG. 6, the displays are given in characters, but they may also be given by symbols. The lower part of the display panel 620 displays the function state of other function modes, to be explained later, within the extent of a line display. The example shown in FIG. 6 indicates that a copy job B is in the course of the output operation to the printer portion. In the display panel 620, at the side of the application mode keypad 626, there is provided a space for the keypads that can be changed by the user, and the user can register two keypads at maximum for the functions that can be set in the application mode setting screen. Such display of the application mode setting keypad in the illustrated position facilitates the execution of thus registered mode.

A proof print mode keypad 632 is used, in case a sorting mode is set by the discharge process setting keypad 632, for setting a proof print mode in which, in case of output of plural copies, the printing operation is interrupted after the output of a copy for causing the user to confirm the finished state, and the printing operation is continued if the finished state is satisfactory but is cancelled if the finished state is unsatisfactory. The default value of the discharge tray for each job type is set by the user setting keypad 618, but a discharge tray keypad 633 allows to individually set the discharge tray for each job, in an image displayed in response to the depression of the discharge tray keypad 633.

In FIG. 6, numerals 601 to 612 indicate keypads and LED's for switching the display of the operating portion for setting the functions of the copying and system operations utilizing the image forming apparatus 99. Keypads 601, 604, 607, 610, used for switching the functions, are composed of semi-transparent keypad buttons provided therein with indicator lamps (not shown) composed of for example of LED's. When an operating image is selected by the depression of the keypad 601, 604, 607 or 610, the lamp in the button is turned on. Among the lamps in these keypads, only the lamp in the keypad corresponding to the selected operating image is turned on while other lamps are turned off.

At the right-hand side of the keypads 601, 604, 607, 610 there are provided green LED's 603, 606, 609, 612 for indicating the function state of various functions. For example, the LED 606 for the copy job B is turned off during the stand-by state thereof but is turned on intermittently during the output operation of the copy job B. A hard disk 404 of the image memory portion 3 (FIG. 4) stores the image of the copy job B, and the LED is turned on in case the printing operation of the copy job B is not executed. Similarly, the facsimile LED 609 is turned on intermittently during the communication operation, printing operation or reading operation, and is turned of if a facsimile image is present in a hard disk 502 of the facsimile portion.

At the left-hand side of the keypads 601, 604, 607, 610 there are provided red LED's 602, 605, 608, 611 to be turned for indicating the abnormal state of various functions. For example, the LED 605 for the copy job B is turned on intermittently in case of an abnormal situation in the copy job B such as interruption by absence of sheet or sheet jam. In such case, a copy B function keypad 604 is depressed to switch the display of the operating portion to the copy B, whereby the display panel displays the status of the copy B for allowing the user to confirm the details of the abnormal situation. Such function switching keypads can be depressed any time regardless of the function state of various functions, thereby switching the operating portion.

In case the copy A function and the copy B function can be switched as in the present embodiment, the keypads other than those in the display panel, such as the aforementioned stop keypad, start keypad, reset keypad etc. are rendered effective for the function selected by the function switching keypads 601, 604. For example, when the copy A operating screen is displayed in the example shown in FIG. 6, the stop keypad cannot stop the copy output operation of the copy job B. The copy output operation of the copy job B can be stopped by depressing the copy B function keypad 604 followed by the depression of the stop keypad 616.

Data set by the user setting keypad 618 are effective in the image in each of the operating portions for the copy A and copy B, and can be used for independently executing a setting operation in each image.

Figure 10:
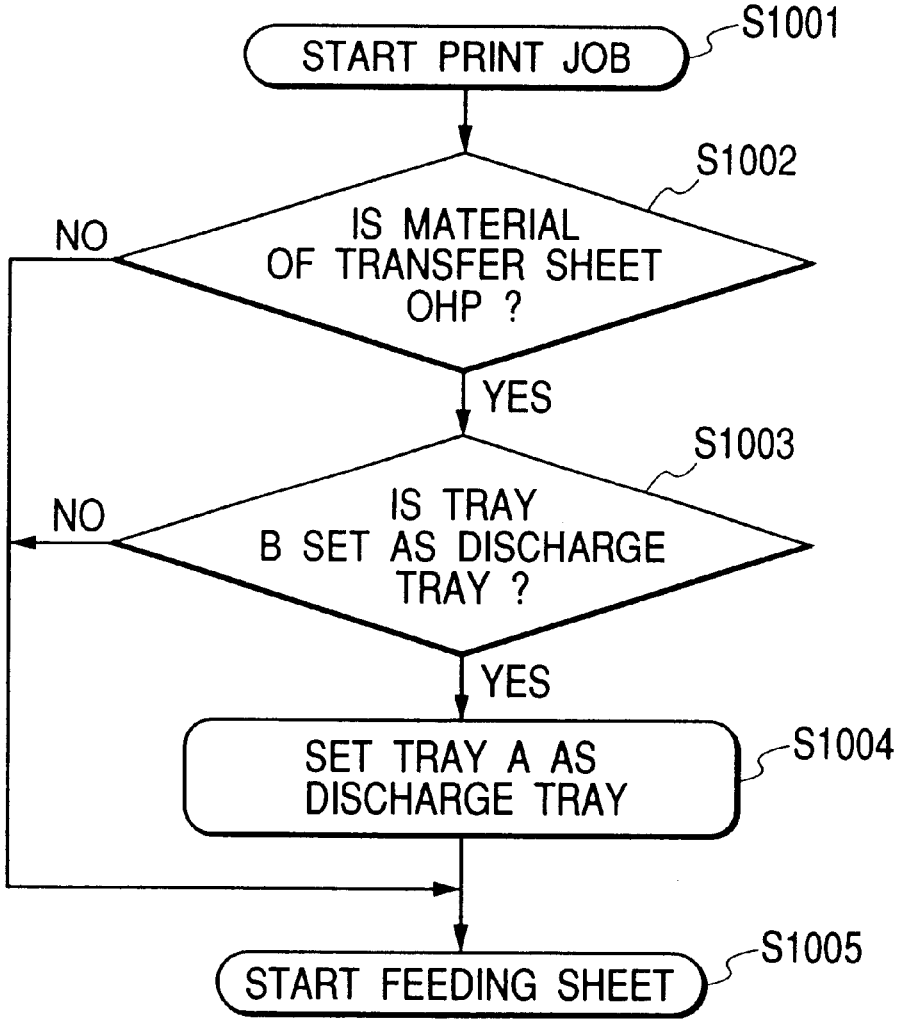
FIG. 10 is a control flowchart in an embodiment of the present invention.

In the following there will be explained the control flow of the embodiment 1 of the present invention, with reference to a flowchart shown in FIG. 10.

When a request for a new print job (hereinafter represented as job A) is generated in a step (abbreviated as S in FIG. 10) S1001, a step S1002 discriminates whether the sheet material in the cassette set in the job A is an OHP sheet.

If the step S1002 identifies that the sheet material is the OHP sheet, a step S1003 discriminates whether the dedicated tray for the job A is set at the discharge tray B 192.

The discrimination is made by whether the discharge tray of the job A is set by the discharge tray setting keypad 633 or by the initial value for the dedicated tray according to the job type. In either setting, if the tray B 192 is selected, a step S1004 resets the display tray to the tray A 101, namely switching to a mode for discharging from the path 194 to the tray A 191.

This is because the post-processing unit 190 in the embodiment is so constructed as to inhibit the conveying of the OHP sheet to the path 195 leading to the tray B 192. After the step S1004, a step S1005 initiates the sheet feeding operation.

On the other hand, if the step S1002 identifies that the sheet material is not the OHP sheet or if the step S1003 identifies that the display tray is not set at the tray B 192, the step S1005 initiates the sheet feeding operation without changing the settings.

The control flow in the embodiment 1 of the present invention is executed as explained in the foregoing.

Figure 11:
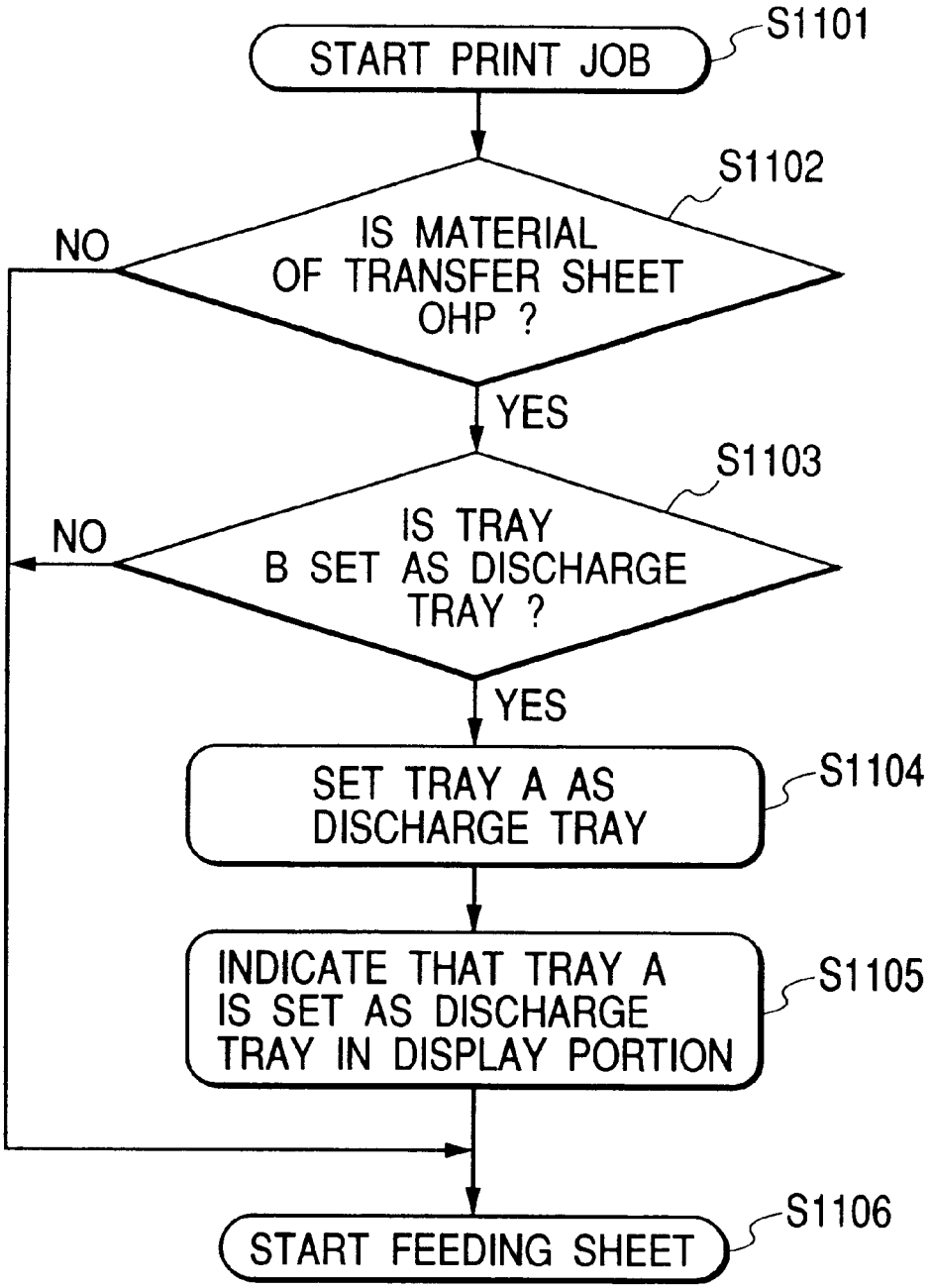
FIG. 11 is a control flowchart in a second embodiment of the present invention.

FIG. 11 is a flowchart showing the control flow of an embodiment 2 of the present invention.

In this embodiment, steps S1101 to S1104 are similar to those S1001 to S1004 in the embodiment 1 and will not be explained further.

Figure 12:
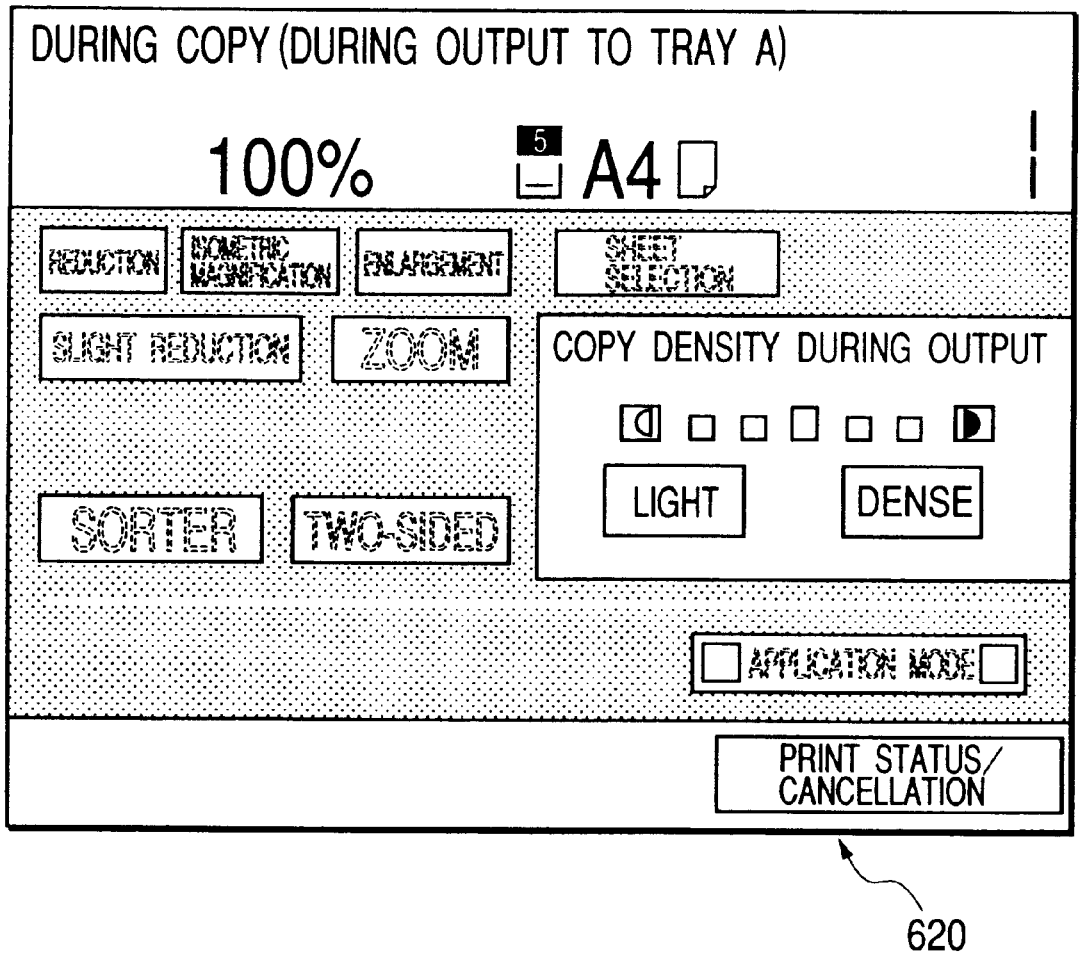
FIG. 12 is a view showing the display panel in case the tray setting is changed.

After the S1104 resets the discharge tray to the tray A 191, a step S1105 displays the currently set discharge tray on the display panel 620 of the operating portion, as shown in FIG. 12, in order to inform that the user setting has been changed.

At the same time a step S1106 initiates the sheet feeding operation.

The control flow in the embodiment 2 of the present invention is executed as explained in the foregoing.

Figure 13:
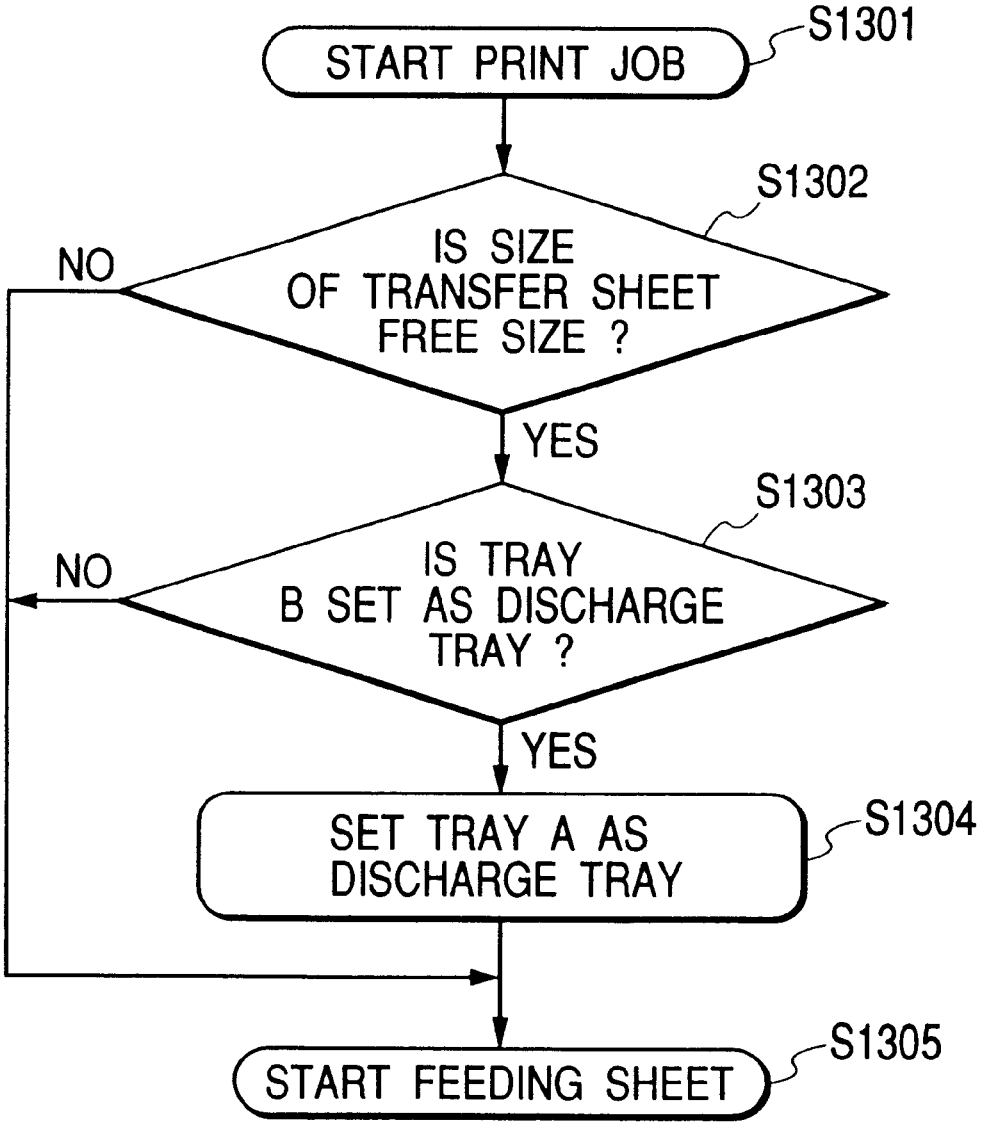
FIG. 13 is a control flowchart in a third embodiment of the present invention.

FIG. 13 is a flowchart showing the control flow of an embodiment 3 of the present invention.

If the start of a new print job (hereinafter called job A) is generated in a step S1301, a step S1302 discriminates whether the sheet size of a cassette set in the job A is free size.

If the step S1302 identifies that the sheet size is free size, a step S1303 discriminates whether the dedicated tray for the job A is set at the discharge tray B 192. The discrimination is made by whether the discharge tray of the job A is set by the discharge tray setting keypad 633 or by the initial value for the dedicated tray according to the job type.

In either setting, if the tray B 192 is selected, a step S1304 resets the display tray to the tray A 191. This is because the post-processing unit 190 in the present embodiment is so constructed as to inhibit the conveying of the free size sheet of which length cannot be judged prior to the start of sheet feeding. After the step S1304, a step S1305 initiates the sheet feeding operation.

On the other hand, if the step S1302 identifies that the sheet size is not free size or if the step S1303 identifies that the discharge tray is not set at the tray B 192, the step S1305 initiates the sheet feeding operation without changing the settings.

The control flow in the embodiment 3 of the present invention is executed as explained in the foregoing.

Figure 14:
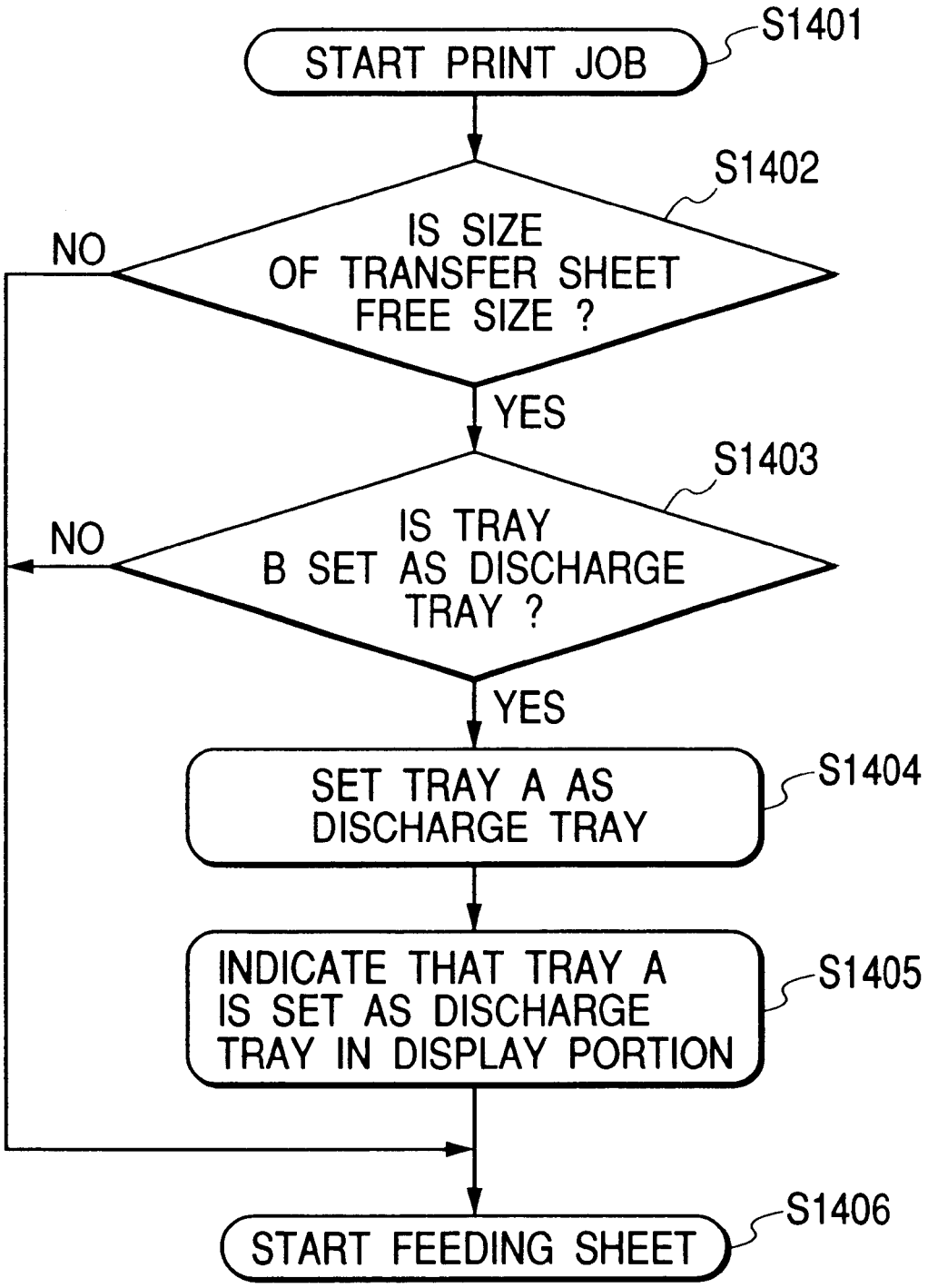
FIG. 14 is a control flowchart in a fourth embodiment of the present invention.

FIG. 14 is a flowchart showing the control flow of an embodiment 4 of the present invention.

In this embodiment, steps S1401 to S1404 are similar to those S1301 to S1304 in the embodiment 3 and will not be explained further.

Also steps S1405, S1406 are similar to the steps S1105 and S1106 of the embodiment 2 and will not be explained further.

The control flow in the embodiment 4 of the present invention is executed as explained in the foregoing.

Figure 15:
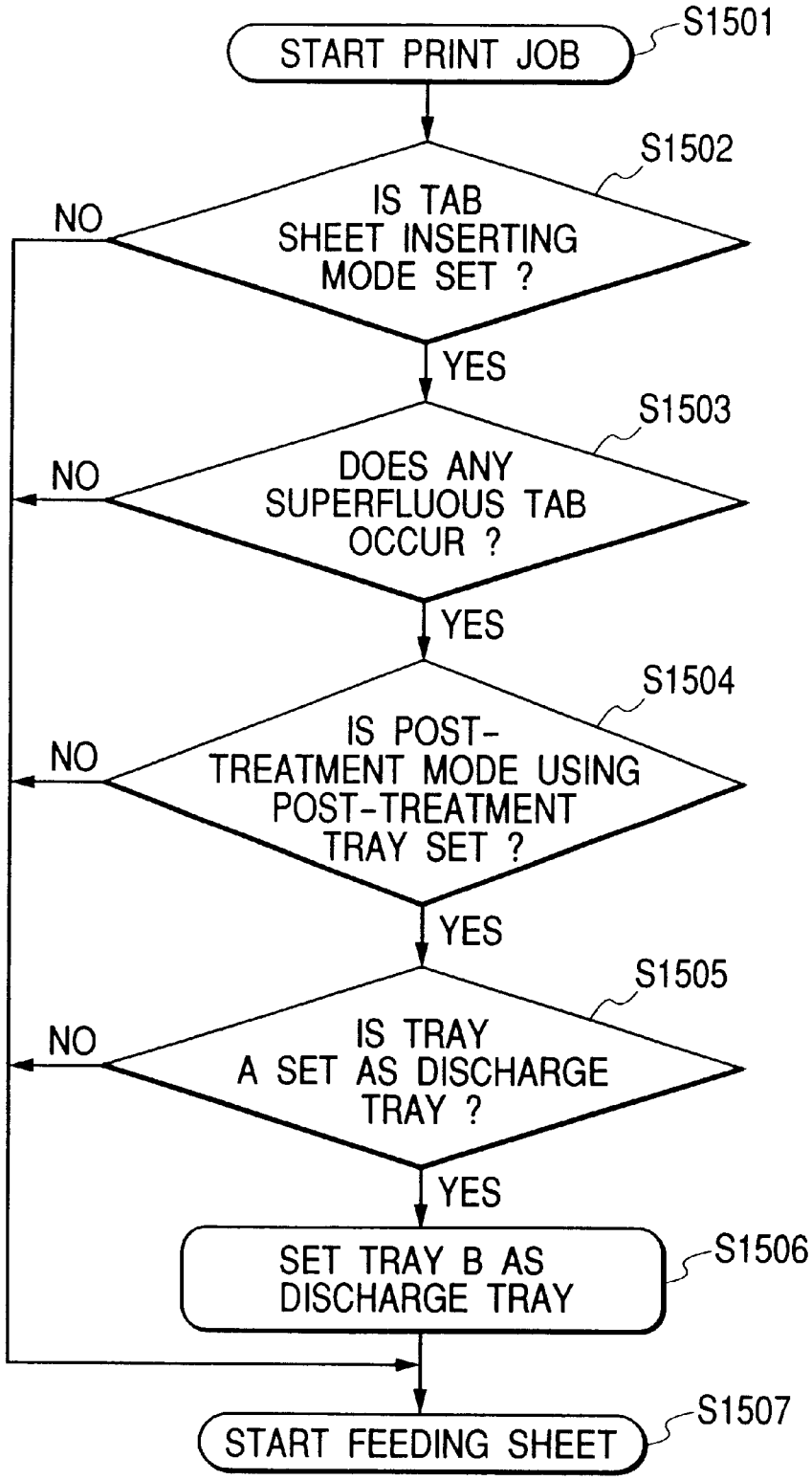
FIG. 15 is a control flowchart in a fifth embodiment of the present invention.

FIG. 15 is a flowchart showing the control flow of an embodiment 5 of the present invention.

If the start of a new print job (hereinafter called job A) is generated in a step S1501, a step S1502 discriminates whether the image forming mode set for the job A is a tab sheet insertion mode.

If the step S1502 identifies that the image forming mode is the tab sheet insertion mode (tab sheets being fed from the cassette 131 or 132), a step S1503 discriminates whether a surplus tab sheet is generated per copy based on the set number of tabs and the number of tab inserting positions. If the step S1503 identifies that a surplus tab sheet is generated per copy, a step S1504 discriminates whether a mode utilizing the post-processing tray 193, such as a stapling mode, is simultaneously set.

If the step S1504 identifies that a mode utilizing the post-processing tray 193 is set, a step S1505 discriminates whether the dedicated tray for the job A is set at the discharge tray A 191. The discrimination is made by whether the discharge tray of the job A is set by the discharge tray setting keypad 633 or by the initial value for the dedicated tray according to the job type. In either setting, if the tray A 191 is selected, a step S1506 resets the display tray to the tray B 192. The tray A 191 corresponds to the sheets from the path 194, and the surplus tab sheet is discharged through the path 194 to the tray A 191.

This is because, in the post-processing unit 190 of the present embodiment, when the discharged sheet is conveyed in the path to the tray A 191 through the post-processing tray 193, there will be no path (and a tray corresponding thereto) for discharging the surplus tab sheet to another tray at the end of output of a copy. After the step S1506, a step S1507 initiates the sheet feeding operation.

On the other hand, if the step S1502 identifies that the tab sheet insertion mode is not set or if the step S1503 identifies that the surplus tab sheet is not generated or if the step S1504 identifies that the post-processing mode for sheet discharge through the post-processing tray 193, the step S1507 initiates the sheet feeding operation without changing the settings.

The control flow in the embodiment 5 of the present t invention is executed ed as explained in the foregoing.

Figure 16:
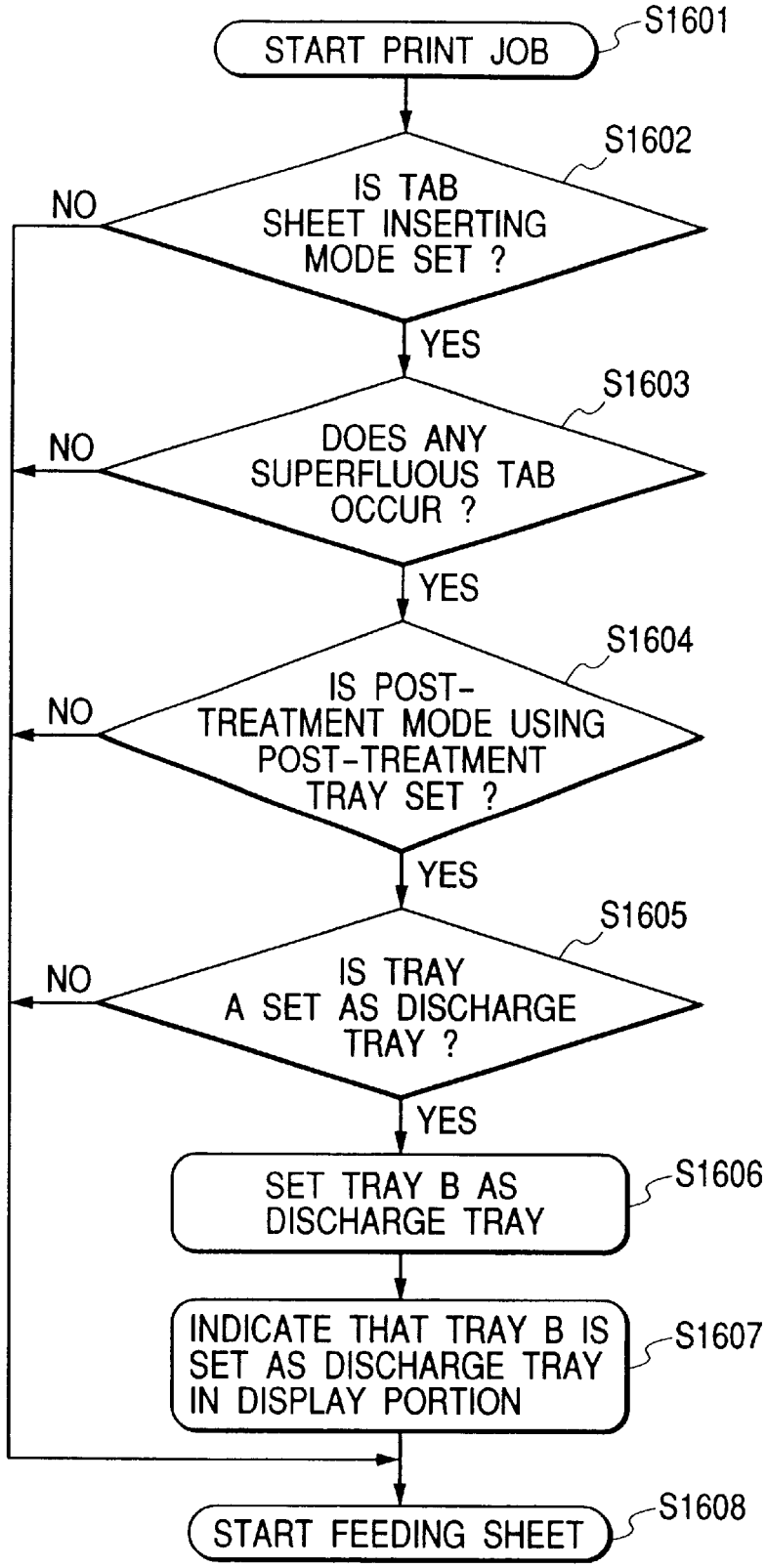
FIG. 16 is a control flowchart in a sixth embodiment of the present invention.

FIG. 16 is a flowchart showing the control flow of an embodiment 6 of the present invention.

In this embodiment, step S1601 to S1606 are similar to those S1501 to S1506 in the embodiment 4 and will not be explained further.

Also steps S1607, S1608 are similar to the steps S1405 and S1406 of the embodiment 4 and will not be explained further.

The control flow in the embodiment 6 of the present invention is executed as explained in the foregoing.

Figure 5:
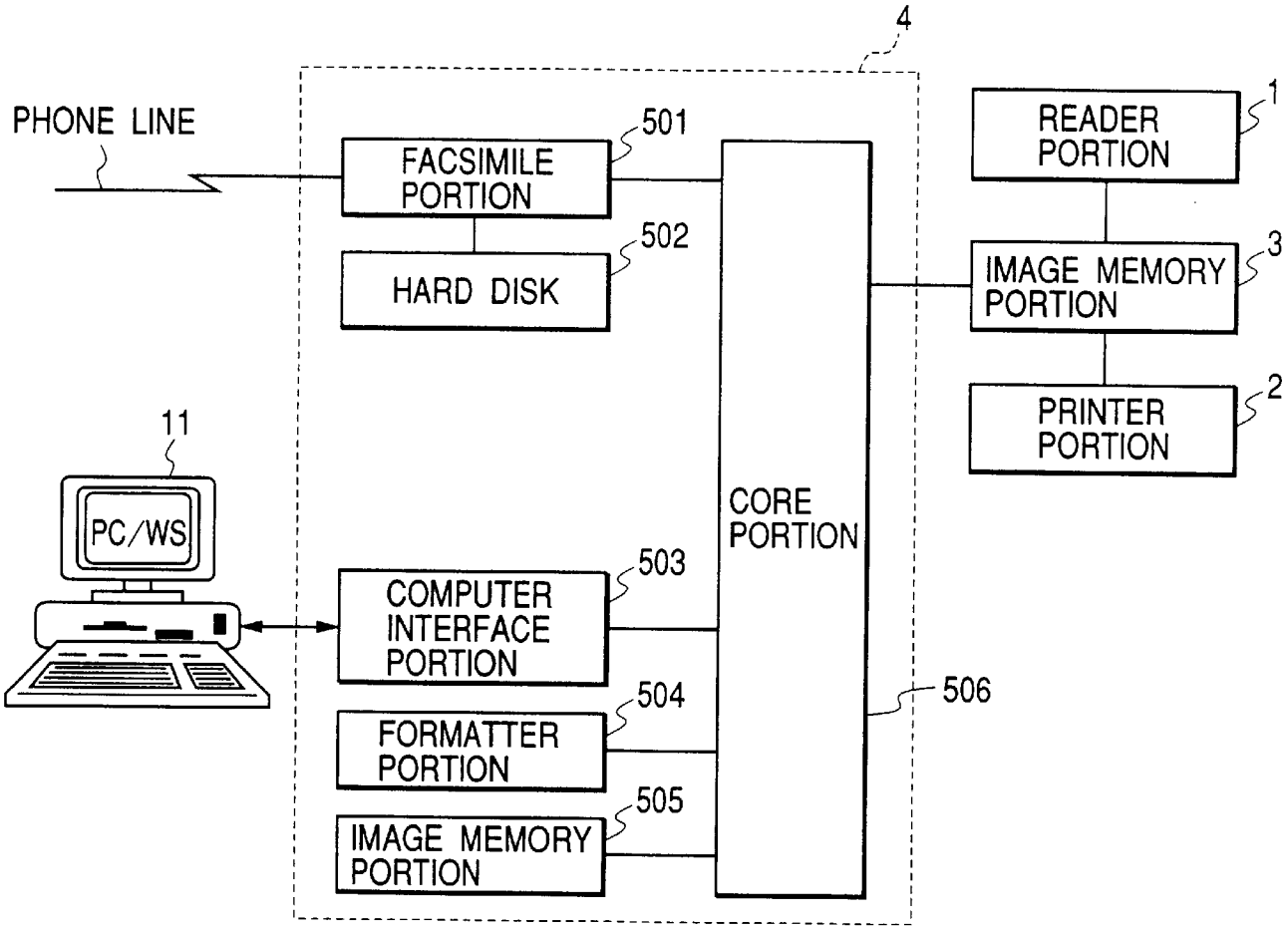
FIG. 5 is a control block diagram of an external I/F processing portion.

In the foregoing image forming apparatus, also in case the image data are entered from the plural image data input means such as the telephone line, the external computer 11, the reader portion 1 etc. as shown in FIG. 5 and the tray (191 or 192) is designated for each image data input means, if the sheet material, sheet size or image forming mode is designated, the sheet discharge may be preferentially made instead of the tray designated by the sheet material, sheet size or image forming mode, and such situation may be displayed on the display panel 620 as shown in FIG. 12.

What is claimed is:

1. An image forming apparatus comprising:

image forming means for forming an image on a sheet;

plural discharged sheet stacking means for stacking said sheet on which the image is formed by said image forming means;

control means for selecting said discharged sheet stacking means according to an image forming job of said image forming means and for selecting said discharged sheet stacking means based on material information of said sheet; and indicating means for indicating selected discharged sheet stacking means onto which said sheet is to be discharged, wherein when said control means selects said discharged sheet stacking means based on the material information of said sheet in preference to said image forming job, said control means causes said indicating means to indicate the selected discharged sheet stacking means.

2. An image forming apparatus according to claim 1, wherein the image forming job is one of a stapling job, a sorting job and a non-stapling and non-sorting job.

3. An image forming apparatus according to claim 1, further comprising informing means for informing that said discharged sheet stacking means is selected based on the material information of said sheet in preference to said image forming job.

4. An image forming apparatus comprising:

plural image data input means for entering image data;

image forming means for forming an image on a sheet based on said image data;

plural discharged sheet stacking means for stacking said sheet on which the image is formed by said image forming means; and control means for selecting said discharged sheet stacking means corresponding to each image data input means and for selecting said discharged sheet stacking means based on material information of said sheet, wherein said control means selects said discharged sheet stacking means based on the material information of said sheet in preference to a kind of said image data input means.

5. An image forming apparatus according to claim 4, further comprising informing means for informing that said discharged sheet stacking means is selected based on the material information of said sheet in preference to said image data input means.

6. An image forming apparatus according to claim 4, wherein said image data input means is one of a phone line, an external computer and a reader portion.

7. An image forming apparatus according to any of claims 1 to 6, wherein said sheet is a sheet for an overhead projector.

8. An image forming apparatus comprising:

image forming means for forming an image on a sheet;

plural discharged sheet stacking means for stacking said sheet on which the image is formed by said image forming means;

control means for selecting said discharged sheet stacking means according to an image forming job of said image forming means and for selecting said discharged sheet stacking means based on size information of said sheet; and indicating means for indicating selected discharged sheet stacking means onto which said sheet is to be discharged, wherein when said control means selects said discharged sheet stacking means based on the size information of said sheet in preference to said image forming job, said control means causes said indicating means to indicate the selected discharged sheet stacking means.

9. An image forming apparatus according to claim 8, further comprising informing means for informing a fact that said discharged sheet stacking means is selected based on the size information of said sheet in preference to said image forming job.

10. An image forming apparatus according to claim 8, wherein the size information of said sheet includes information that said sheet is free size.

11. An image forming apparatus comprising:

plural image data input means for entering image data;

image forming means for forming an image on a sheet based on said image data;

plural discharged sheet stacking means for stacking said sheet on which the image is formed by said image forming means; and control means for selecting said discharged sheet stacking means corresponding to each image data input means and for selecting said discharged sheet stacking means based on size information of said sheet, wherein said control means selects said discharged sheet stacking means based on the size information of said sheet in preference to a kind of said image data input means.

12. An image forming apparatus according to claim 11, wherein said image data input means is one of a phone line, an external computer and a reader portion.

13. An image forming apparatus according to claim 11, further comprising informing means for informing that said discharged sheet stacking means is selected based on the size information of said sheet in preference to the said image data input means.

14. An image forming apparatus according to any of claims 8 to 13, wherein said sheet is a free-sized sheet.

15. An image forming apparatus comprising:

image forming means for forming an image on a sheet;

plural discharged sheet stacking means for stacking said sheet on which the image is formed by said image forming means;

mode setting means for setting a tab sheet insertion made for generating a series of a sheet bundle containing a tab sheet relating to said image forming means; and control means for selecting said discharged sheet stacking means according to an image forming job of said image forming means and for selecting said discharged sheet stacking means based on said tab insertion mode, wherein said control means selects said discharged sheet stacking means based on said tab sheet insertion mode in preference to said image forming job.

16. An image forming apparatus according to claim 15, further comprising informing means for informing that said discharged sheet stacking means is selected based on said tab sheet insertion mode in preference to said image forming job.

17. An image forming apparatus according to claim 1, 4, 8, 11 or 15, wherein said plural discharged sheet stacking means include a first tray for stacking sheet bundles stapled by stapling means and a second tray for stacking unstapled sheets, wherein said first and second trays are mutually positioned above and below so as to correspond to respective discharge exits, and said first tray receives stapled sheets corresponding to a first discharge exit while said second tray receives unstapled sheets corresponding to a second discharge exit or the stapled sheets corresponding to said first discharge exit.

18. An image forming apparatus according to claim 17, wherein, when said first tray is full, said second tray moves to said first discharge exit and receives the stapled sheets.

19. An image forming apparatus according to claim 18, wherein said first discharge exits is positioned below while said second discharge exit is positioned thereabove, and a conveying path leading to said first discharge exit is provided therein with a stapling tray and stapling means and is curved, while a conveying path leading to said second discharge exit is substantially straight.

20. An image forming apparatus comprising:

plural image data input means for entering image data;

image forming means for forming an image on a sheet based on said image data;

plural discharged sheet stacking means for stacking said sheet on which the image is formed by said image forming means;

mode setting means for setting a tab sheet insertion mode for generating a series of a sheet bundle containing a tab sheet; and control means for selecting said discharged sheet stacking means corresponding to each image data input means and for selecting said discharged sheet stacking means based on said tab sheet insertion mode, wherein said control means selects said discharged sheet stacking means based on said tab sheet insertion mode in preference to a kind of said image data input means.

21. An image forming apparatus according to claim 20, further comprising informing means for informing that said discharged sheet stacking means is selected based on said tab sheet insertion mode in preference to the kind of said image data input means.

22. An image forming apparatus according to claim 20, wherein said plural discharged sheet stacking means include a first tray for stacking sheet bundles stapled by stapling means and a second tray for stacking unstapled sheets, wherein said first and second trays are mutually positioned above and below, and said second tray can be placed in a position for receiving the unstapled sheets when said first tray is in a position for receiving the stapled sheets, and wherein said first and second trays are preferentially positioned as described above in said tab sheet insertion mode and a surplus tab sheet is discharged to said second tray.

* * * * *

UNITED STATES PATENT AND TRADEMARK OFFICE

CERTIFICATE OF CORRECTION

PATENT NO. : 6,393,232 B1
DATED : May 21, 2002
INVENTOR(S) : Yoshihito Osari et al.

It is certified that error appears in the above-identified patent and that said Letters Patent is hereby corrected as shown below:

Column 4,
Line 33, “received” should read -- receive --.

Column 10,
Line 4, “control” should read -- controls --.

Column 16,
Line 6, “t” should be deleted.

Column 18,
Line 28, “exits” should read -- exit --.

Signed and Sealed this

Sixth Day of August, 2002

*Attest:*

*Attesting Officer*

JAMES E. ROGAN
*Director of the United States Patent and Trademark Office*